US006818605B1

(12) United States Patent
Ban et al.

(10) Patent No.: US 6,818,605 B1
(45) Date of Patent: Nov. 16, 2004

(54) GRANULATED DETERGENT COMPOSITION

(75) Inventors: Takeshi Ban, Wakayama (JP); Teruo Kubota, Wakayama (JP); Shu Yamaguchi, Wakayama (JP); Hiroyuki Saijo, Wakayama (JP); Hiroyuki Yamashita, Wakayama (JP)

(73) Assignee: Kao Corporation, Tokyo (JP)

( * ) Notice: Subject to any disclaimer, the term of this patent is extended or adjusted under 35 U.S.C. 154(b) by 163 days.

(21) Appl. No.: 10/009,684

(22) PCT Filed: Jun. 16, 2000

(86) PCT No.: PCT/JP00/03921

§ 371 (c)(1),
(2), (4) Date: Dec. 13, 2001

(87) PCT Pub. No.: WO00/77161

PCT Pub. Date: Dec. 21, 2000

(30) Foreign Application Priority Data

Jun. 16, 1999 (JP) ..... 11/169565

(51) Int. Cl.[7] ..... C11D 17/00
(52) U.S. Cl. ..... 510/276; 510/444
(58) Field of Search ..... 510/276, 444

(56) References Cited

U.S. PATENT DOCUMENTS 4,715,979 A * 12/1987 Moore et al. ..... 510/297
4,869,843 A * 9/1989 Saito et al. ..... 510/349
4,970,017 A * 11/1990 Nakamura et al. ..... 510/441
5,178,798 A * 1/1993 Jolicoeur ..... 510/441
5,516,447 A * 5/1996 Bauer et al. ..... 510/535
5,914,307 A * 6/1999 DeNome et al. ..... 510/444
6,376,453 B1 4/2002 Kubota et al. ..... 510/438
6,602,846 B1 * 8/2003 Kubota et al. ..... 510/444

FOREIGN PATENT DOCUMENTS

| | | | |
|---|---|---|---|
| DE | 3617756 | A | 12/1986 |
| EP | 0512552 | A1 | 11/1992 |
| JP | 63-150398 | A | 6/1988 |
| JP | 04-322797 | | 11/1992 |

* cited by examiner

*Primary Examiner*—Lorna M. Douyon
(74) *Attorney, Agent, or Firm*—Birch, Stewart, Kolasch & Birch, LLP

(57) ABSTRACT

The present invention relates to a granular detergent composition having easy measurability and distributivity suitable for spoon measurement, a bulk density thereof being 500 g/L or more, containing a surfactant, a water-insoluble inorganic compound and a water-soluble salt, wherein the granular detergent composition has a variance of powder dropping rate V of 1.0 or less, an inserting pressure P of 80 gf/cm or less, a Δ dropping ratio D of 14% of les, and an index K of from 30 to 230, the index K being represented by the equation: $K=P\times\exp(0.135\times D)$, wherein P stands for an inserting pressure (gf/cm), and D stands for a Δ dropping ratio (%); and a process for preparing the same.

3 Claims, 8 Drawing Sheets

(1)

(2)

GRANULATED DETERGENT COMPOSITION

This application is the national phase under 35 U.S.C. § 371 of PCT International Application No. PCT/JP00/03921 which has an International filing date of Jun. 16, 2000, which designated the United State of America.

TECHNICAL FIELD

The present invention relates to a granular detergent composition having easy measurability and distributivity suitable for use with a spoon.

BACKGROUND ART

The compactification of the powder detergent starting from 1987 has been popularized globe-wide within a short period of time, because the compactification has brought about great merits such as dramatic improvements in convenience of the users together with measuring method with spoons, and improvement of transportation efficiency and reduction of volume of space occupied in distributions and homes.

The technique for compactifying the powder detergent has been intensively studied in the recent years, but the main object of the problem of the technique is "how to compactify powder detergent." In other words, the studies on improving the powder properties in compact detergents are remarked on solving problems such as caking property caused by compactification and suitability upon production, which are solutions for negative problems. Therefore, almost no attempts have been made for improving users' feel or convenience of the consumers by remarkably improving the powder properties of the granular detergent composition, which is a proposal of positive value.

For instance, in conventional powder detergents, in the scooping movements with a spoon, since the stress from the detergent becomes large as the detergent is packed in the scooping portion of the spoon, the carton undesirably moves when this operation is carried out single-handedly, so that there arise problems that the detergent is not easily scooped, and that the detergent is undesirably spilled from the carton.

In addition, in the movement for spoon measurement after scooping, it has been difficult to level the detergent to a measurement scale owing to the fact that the cascading of the detergent particles from the spoon is discontinuous, for instance, the detergent particles suddenly flow downwards after tilting the spoon to get to a certain point, and the like. Moreover, it has been difficult to carry out an accurate measurement, because the packing structure of the detergent particles in the scooping portion of the spoon changes by repeatedly carrying out scooping movements in order to level the detergent to a given measurement scale.

Further, when the detergent is supplied into a washing machine, those detergents in which the cascading of the detergent particles is discontinuous are highly likely to be supplied as a lumpy mass. As a result, when a detergent is supplied before pouring water, and further washing is carried out at a low liquor ratio with gentle agitation, there arise problems such that the detergent is aggregated when pouring water at which point no mechanical power is applied, and further that the detergent aggregate does not sufficiently distribute owing to a gentle agitation force, so that there is likely to cause inconvenience that water-insoluble inorganic compounds remain on clothes.

DISCLOSURE OF INVENTION

In a high-density granular detergent composition, in order to conveniently carry out the operations of measuring the high-density granular detergent composition using a spoon-shaped measuring device, and supplying the granular detergent composition into a washing machine, it is desired that the granular detergent composition is easily scoopable, and that the granular detergent composition can be easily leveled to a desired measurement scale (hereinafter referred to as "easy measuring"). In addition, in order to reduce the troubles that the water-insoluble inorganic compounds remain on clothes, it is desired that the granular detergent composition is easily evenly distributed when the detergent is supplied to a washing machine (hereinafter referred to as "easy distributing"). Further, smooth powdery texture powder is pleasant for users.

Therefore, the present invention provides a high-density granular detergent composition having easy measurability and distributivity suitable for use with spoon measurement, and having high users' feel of the consumers, and a process for preparing the granular detergent composition, in which the powder properties of the granular detergent composition are remarkably improved, so that the remnants of the granular detergent composition on clothes after washing are remarkably reduced because the granular detergent composition is less likely to be supplied as a lumpy mass, and that the users can easily carry out measurement operation of a detergent using a measuring device such as spoon.

For the purpose of obtaining a granular detergent composition having all of easy scooping, easy measuring and easy distributing, the present inventors have examined easy scooping with a spoon, and easy measuring and easy distributing for 100 or more samples in which the powder properties of the granular detergent composition such as a time period for flowability, a bulk density, an average particles size, a particle size distribution, a fine powder ratio, a degree of spherocity, and a tensile strength of a powder layer are variously changed.

As a result, it has been elucidated that it would be quite difficult to achieve the problem solving of the present invention by simply optimizing the conventionally used index for flowability, such as a time period (flow time) required for flowing a given amount of the granular detergent composition from a hopper used in a measurement of bulk density according to JIS K 3362. This is because these flowability indexes simply express powder properties within a given time period from a start of flow to an end of flow of powder, and cannot express changes of complicated flowability behaviors of the granular detergent composition which vary with time within a second time period, and the like.

Therefore, while the present inventors have proceeded with data analysis for previously obtained various detergent samples, they have analyzed in detail the movements of users from measurement to supply of the detergent, such as "scooping," "measuring," and "distributing." As a result, they have newly achieved introduction of powder property indexes more closely adapting to the actual situation, including an inserting pressure (P) as an index for expressing easy scooping, a Δ dropping ratio (D) as an index for easy measuring, and a variance of powder dropping rate (V) as an index for expressing easy distributing.

Therefore, first, they have examined the relationship between the variance of powder dropping rate (V), which is an index for expressing easy distributing, and the property of insoluble remnants of the granular detergent composition, and found conditions that can reduce the generation of the insoluble remnants of the granular detergent composition by adjusting the variance of powder dropping rate (V) to a given value or less.

Subsequently, in order to obtain conditions for having both easy scooping and easy measuring, in addition to the above easy distributing, the studies have been continued by varying operating factors drawn on two axes of the inserting pressure (P) as an index for expressing easy scooping and the Δ dropping ratio (D) as that for easy measuring. As a result, it has been found that it is important that both the inserting pressure (P) and the Δ dropping ratio (D) are small, and when both factors have the relationship within a specified range (index K), a realistic solving means for the above problems can be provided.

As a result, the present inventors have found that a granular detergent composition having easy measurability and distributivity suitable for spoon measurement, the granular detergent composition having convenience not conventionally found and smooth powdery texture not so far found, which can also express its commercial value as "capable of scooping single-handedly without spilling, with a single-step measurement, and with reduced insoluble remnants."

In addition, they studied on a process for preparation for the granular detergent composition having easy measurability and distributivity suitable for spoon measurement. As a result, it has been elucidated that in the preparation of the granular detergent composition, the control of each of the operation factors of the present invention, the variance of powder dropping rate (V), the inserting pressure (P), and the Δ dropping ratio (D), can be achieved by carrying out the adjustment operations for the powder properties comprising the particle size adjustment, the particle shape adjustment and the adjustment of intergranular cohesive forces.

In particular, by adjusting each of adjustment factors such as the average particle size of the granular detergent composition, the particle size distribution (Rosin-Rammler's distribution index), the fine powder ratio having a particle size of 125 μm or less, the degree of spherocity, the tensile strength of the powder layer to preferable operation ranges which minimally meet the requirement, and further by especially adjusting two or more selected from the above-mentioned items, they have found that a granular detergent composition having easy measurability and distributivity suitable for desired spoon measurement is extremely easily obtained, and the present invention has been perfected thereby.

Specifically, the present invention relates to:

[1] a granular detergent composition having easy measurability and distributivity suitable for spoon measurement, a bulk density thereof being 500 g/L or more, comprising a surfactant, a water-insoluble inorganic compound and a water-soluble salt, wherein the granular detergent composition has a variance of powder dropping rate V of 1.0 or less, an inserting pressure P of 80 gf/cm or less, a Δ dropping ratio D of 14% or less, and an index K of from 30 to 230, the index K being represented by the equation (1):

$$K=P\times\exp(0.135\times D) \quad (1)$$

wherein P stands for an inserting pressure (gf/cm), and D stands for a Δ dropping ratio (%); and

[2] a process for preparing a granular detergent composition having easy measurability and distributivity suitable for spoon measurement, a bulk density thereof being 500 g/L or more, comprising a surfactant, a water-insoluble inorganic compound and a water-soluble salt, wherein the process comprises carrying out a particle size adjustment, a granular shape adjustment and an adjustment of intergranular cohesive forces such that detergent particles constituting the granular detergent composition have a variance of powder dropping rate V of 1.0 or less, an inserting pressure P of 80 gf/cm or less, a Δ dropping ratio D of 14% or less, and an index K of from 30 to 230, the index K being represented by the equation (1) as defined in item [1] above.

BRIEF DESCRIPTION OF THE DRAWINGS

FIG. 2(2) is a perspective view of the holding member.

BEST MODE FOR CARRYING OUT THE INVENTION

Figure 1:
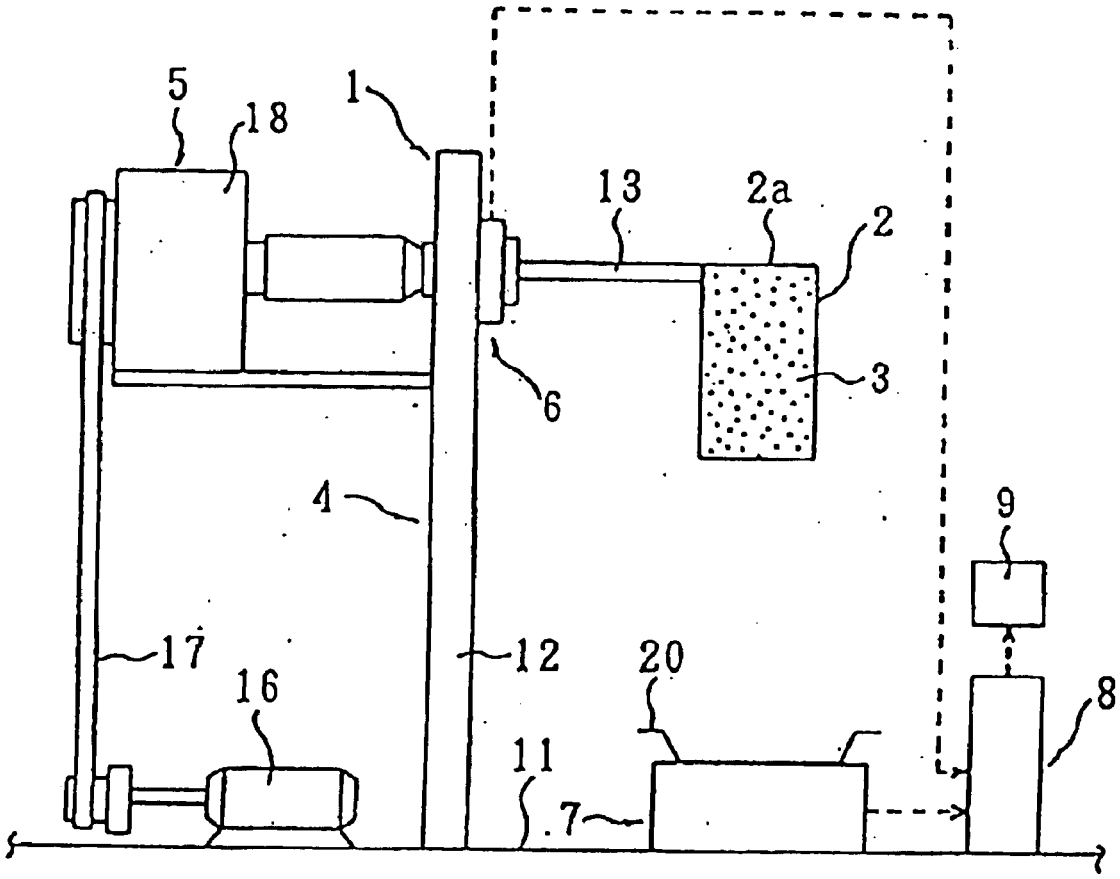
FIG. 1 is a schematic view showing a measurement device for flowability properties of the powder. In the FIG. 2 is a holding member, 2*a* is a cascading portion, 3 is powder, 7 is a weight measurement device, and 20 is a receiver.

The detergent particles as referred to in the present invention are a particle comprising a surfactant, a water-insoluble inorganic compound and a water-soluble salt. In addition, the granular detergent composition means a composition comprising the detergent particles, and further comprising separately added detergent components other than the detergent particles (for instance, builder granules, fluorescent dyes, enzymes, perfumes, defoaming agents, bleaching agents, bleaching activators, and the like). Also, the detergent article means an article in which a container (for instance, carton and the like) is equipped with a spoon-shaped measuring device, wherein a granular detergent composition is sealed in the container. In addition, in the present invention the "water-insoluble inorganic compound" refers to an inorganic compound of which solubility is less than 0.5 g based on 100 g of water at 25° C., and the "water-soluble salt" refers to a compound of which solubility is 0.5 g or more based on 100 g of water at 25° C., and molecular weight is less than 1000.

1. Granular Detergent Composition of Present Invention (1) Surfactant

The surfactant formulated in the granular detergent composition of the present invention has a content of preferably from 10 to 60% by weight, more preferably from 15 to 50% by weight, still more preferably from 20 to 45% by weight, of the granular detergent composition, from the viewpoints of obtaining the detergency and the desired powder properties of the granular detergent composition. The surfactant comprises an anionic surfactant and/or a nonionic surfactant, and it may also comprise a cationic surfactant and an amphoteric surfactant as occasion demands.

The anionic surfactants include alkylbenzenesulfonates, alkyl or alkenyl ether sulfates, alkyl or alkenyl sulfates, α-olefinsulfonates, α-sulfofatty acid salts or esters thereof, alkyl or alkenyl ether carboxylates, salts of fatty acids, alkyl phosphates, and the like. The anionic surfactant has a content of preferably from 1 to 50% by weight, more preferably from 5 to 30% by weight, of the granular detergent composition, from the viewpoint of the detergency.

The nonionic surfactants include polyoxyalkylene alkyl ethers, polyoxyalkylene alkylphenyl ethers, polyoxyalkylene fatty acid esters, polyoxyethylene-polyoxypropylene alkyl ethers, polyoxyalkylene alkylamines, glycerol fatty acid esters, higher fatty acid alkanolamides, alkylglycosides, alkylglucosamides, alkylamine oxides, pluronic type nonionic surfactants, and the like. From the viewpoint of the detergency, the polyoxyalkylene alkyl ethers are preferable, which are ethylene oxide adducts, or mixture adducts of ethylene oxide and propylene oxide, each of which alcohol moiety has 10 to 18 carbon atoms, preferably 12 to 14 carbon atoms, the average moles of each alkylene oxide being 5 to 30, preferably 6 to 15.

The nonionic surfactant has a content of preferably from 1 to 50% by weight, more preferably from 5 to 30% by weight, still more preferably from 5 to 15% by weight, of the granular detergent composition, from the viewpoint of the detergency.

The cationic surfactants include alkyl trimethylammonium salts, and the amphoteric surfactants include carbobetain-type and sulfobetain-type amphoteric surfactants.

(2) Water-Insoluble Inorganic Compound

In order to serve as a water-softening agent and an aid for making preparation (oil-absorbing agent and surface coating agent), in the granular detergent composition of the present invention, the water-insoluble inorganic compound is contained in an amount of preferably from 3 to 60% by weight, more preferably from 5 to 50% by weight, still more preferably from 10 to 45% by weight, particularly preferably from 15 to 40% by weight, most preferably from 15 to 37% by weight, especially preferably from 20 to 35% by weight, in the composition.

The water-insoluble inorganic compound includes, for instance, crystalline aluminosilicates, amorphous aluminosilicates, silicon dioxides, hydrated silicate compounds, clay compounds such as perlite and bentonite, and the like. From the viewpoints of having the deterging ability and not promoting the generation of insoluble remnants of the granular detergent composition, the crystalline aluminosilicates are preferable. Those preferable as the crystalline aluminosilicates are A-type zeolites (for instance, trade name: "TOYOBUILDER," manufactured by Tosoh Corporation; "Zeolite 4A powder" manufactured by Zeobuilder; "Zeolite" manufactured by Nippon Builder; "VEGOBOND" manufactured by Condia), which are also preferable from the viewpoints of the metal ion capturing ability and the economic advantages. Here, it is preferable that the value for the oil-absorbing ability of A-type zeolite measured by a method according to JIS K 5101 is 40 mL/100 g or more. Besides the above, preferable crystalline aluminosilicates include P-type (examples include trade names: "Doucil A24" and "ZSE064", each manufactured by Crosfield B. V.; oil-absorbing ability: 60 to 150 mL/100 g); X-type (examples include trade name: "Wessalith XD"; manufactured by Degussa-AG; oil-absorbing ability: 80 to 100 mL/100 g), and hybrid zeolite described in WO 98/42622.

As the amorphous aluminosilicates, from the viewpoint of maintaining high dissolubility even after stored for a long period of time (without undergoing property changes), its $SiO_2/Al_2O_3$ (molar ratio) is preferably 4.0 or less, more preferably 3.3 or less. The amorphous aluminosilicates include those having properties described on Japanese Patent Laid-Open No. Hei 5-5100, column 4, line 34 to column 6, line 16 (especially, the oil-absorbing carriers described on column 4, lines 43 to 49); and Japanese Patent Laid-Open No. Hei 6-179899, column 12, line 12 to column 13, line 17 and column 17, line 34 to column 19, line 17. Among them, those with 0 to 0.7 mL/g of pores having a pore size, as determined by a mercury porosimeter (manufactured by SHIMADZU CORPORATION, "SHIMADZU Poresizer 9320"), of 0.015 to 0.5 μm, and those with 0.30 mL/g or more of pores having a pore size of 0.5 to 2 μm, are preferable.

(3) Water-Soluble Salt

In order to improve detergency, the water-soluble salt is contained in an amount of preferably from 3 to 60% by weight, more preferably from 5 to 55% by weight, still more preferably from 10 to 50% by weight, especially preferably from 30 to 45% by weight, of the granular detergent composition of the present invention.

The water-soluble salt includes, for instance, inorganic salts such as carbonates, hydrogencarbonates, sulfates, and sulfites; and organic acid salts such as citrates and ethylenediaminetetraacetate, and the like.

(4) Other Ingredients

In the granular detergent composition of the present invention, from the viewpoints of the metal ion capturing ability and the dispersion ability of the solid particle stains, it is preferable to formulate cation-exchange-type polymers having carboxylate group and/or sulfonate group. Especially, there can be formulated a polyacrylate such as a salt of acrylic acid-maleic acid copolymer and a salt of acrylic acid homopolymer, each having a molecular weight of from 1000 to 80000, and a polyacetal carboxylate such as and a polyglyoxylic acid having a molecular weight of from 800 to 1000000, preferably from 5000 to 200000, as described in Japanese Patent Laid-Open No. Sho 54-52196. From the viewpoint of the detergency, the cation-exchange-type polymer is contained in an amount of preferably from 0.5 to 12% by weight, more preferably from 1 to 10% by weight, still more preferably from 1 to 7% by weight, especially preferably from 2 to 5% by weight, of the granular detergent composition.

As an alkalizing agent, an amorphous or crystalline silicate is also a preferable base material. The silicate is contained in an amount of preferably from 0.5 to 40% by weight, more preferably from 3 to 30% by weight, of the granular detergent composition.

In the present invention, in order to prevent that the tensile strength of the powder layer is increased by bleeding out the nonionic surfactant, which is liquid at a room temperature, from the granules during storage, or that the powder layer is more likely to be caked during storage, there can be formulated a water-soluble, nonionic, organic compound having a melting point of 45° to 100° C. and a molecular weight of 1000 to 30000 (hereinafter referred to as "melting point-elevating agent"), or an aqueous solution thereof. The melting point-elevating agent which can be used in the present invention includes, for instance, polyethylene glycols, polypropylene glycols, and the like.

In addition, for the similar purpose of preventing bleed-out, there can be formulated an anionic surfactant having carboxylate group or phosphate group (excluding those additionally having sulfate group or sulfonate group) (hereinafter referred to as "gelating agent"). Concrete examples thereof include anionic surfactants such as salts of fatty acids, salts of hydroxyfatty acids, and alkylphosphates, and the like. Especially, from the viewpoint of the dissolubility, preferred ones include one or more kinds selected from alkali metal salts such as sodium salts and potassium salts, and salts of amines such as alkanolamines, of fatty acids or hydroxyfatty acids each having 10 to 22 carbon atoms.

The melting point-elevating agent and the gelating agent are collectively referred to as "bleed-out preventing agent." The bleed-out preventing agent can be formulated at a proportion of preferably from 1 to 100 parts by weight, more preferably from 5 to 80 parts by weight, still more preferably from 10 to 75 parts by weight, still more preferably from 20 to 75 parts by weight, especially preferably from 30 to 75 parts by weight, based on 100 parts by weight of the nonionic surfactant component. In addition, as the bleed-out preventing agent, when a mixture of the melting point-elevating agent and the gelating agent is used, the bleed-out preventing effect and the anti-caking property can be further improved. In this case, the weight ratio of the melting point-elevating agent to the gelating agent is preferably from 10/1 to 1/10, more preferably from 8/1 to 1/8, still more preferably from 3/1 to 1/3, especially preferably from 3/1 to 3/4.

In addition, although a preferable embodiment is to formulate a nonionic surfactant from the viewpoint of the improvement of the detergency, from the same viewpoints as above, the nonionic surfactant is preferably used in combination with the anionic surfactant. The weight ratio of the anionic surfactant to the nonionic surfactant, namely the anionic surfactant/the nonionic surfactant, is preferably from 19/1 to 1/19, more preferably from 19/1 to 4/16, still more preferably from 19/1 to 7/13, still more preferably from 19/1 to 10/10.

In the granular detergent composition of the present invention, there can be formulated dispersing agents such as carboxymethyl celluloses, polyethylene glycols, and polyvinyl alcohols; or dye-transfer inhibitors such as polyvinyl pyrrolidones; bleaching agents such as percarbonates; bleaching activators such as compounds listed in Japanese Patent Laid-Open No. Hei 6-316700 and tetraacetylethylenediamine; enzymes such as protease, cellulase, amylase, and lipase; biphenyl-type and/or stilbene-type fluorescent dyes; defoaming agents; antioxidants; blueing agents; perfumes, and the like. Incidentally, granules prepared by separately granulating an enzyme, a bleaching activator, a defoaming agent, and the like may be after-blended.

2. Powder Properties

The granular detergent composition of the present invention is excellent in the easy measurability and the distributivity suitable for use with spoon measurement. These excellent properties such as easy measurability and distributivity are exhibited by having the powder properties described below. Here, all of the powder properties described below are those which are determined in a thermostatic chamber kept at a temperature of 25°±5° C. and a humidity of 40±10%.

(1) Inserting Pressure (P)

In the present invention, an inserting pressure P is used as an index for easy scooping with a spoon-shaped measuring device. The inserting pressure P is expressed as a stress caused when a defined adaptor is inserted at a constant speed in a vertical direction to the granular detergent composition packed in a defined container, the insertion being made in a unit length. The inserting pressure is related to a stress caused when a user inserts a spoon into the granular detergent composition: The lower the inserting pressure of the granular detergent composition, less likely the carton moves, when the granular detergent composition is scooped with a spoon, thereby making it easy to operate single-handedly, so that the concern such as spilling of the granular detergent composition is reduced.

From the above reasons, the inserting pressure P of the high-density granular detergent composition of the present invention is adjusted to 80 gf/cm or less, more preferably 60 gf/cm or less, still more preferably 40 gf/cm or less, especially preferably 30 gf/cm or less.

The inserting pressure P is determined as follows.

A granular detergent composition to be tested is poured in a sufficient amount into a metallic cylindrical container having a diameter of 5.0 cm and a volume of 100 ml by using a hopper as defined by JIS K 3362, and a portion filled over the brim is removed by gentle leveling to make the powder surface horizontal. A metallic cylindrical adaptor having an inner diameter of 3.0 cm, a height of 3.5 cm, and a hollow internal portion with a thickness of 1.5 mm is attached to a stress measurement device, and inserted in a vertical direction to the powder poured into the above container at a speed of 2.0 cm/min. A maximum stress caused between the cylindrical adaptor and the detergent when the cylindrical adaptor is inserted for 1.0 cm is defined as an inserting pressure P (gf/cm). Here, as the stress measurement device, there can be used, for instance, "RHEOTECH" manufactured by FUDOH and the like. As the cylindrical adaptor, there can be used, for instance, an adaptor for consistency measurement manufactured by RHEOTECH.

(2) Δ Dropping Ratio (D)

In the present invention, the Δ dropping ratio D is used as an index for expressing easiness of leveling a granular detergent composition to a measurement scale of a spoon-shaped measuring device, and expressing measurability of the granular detergent composition from a spoon-shaped measuring device. The Δ dropping ratio D is an index which more accurately shows the extent of the flowability of the granular detergent composition when measured with a spoon, as compared to an index of flowability using the flow time from a hopper, or the like.

Figure 2:
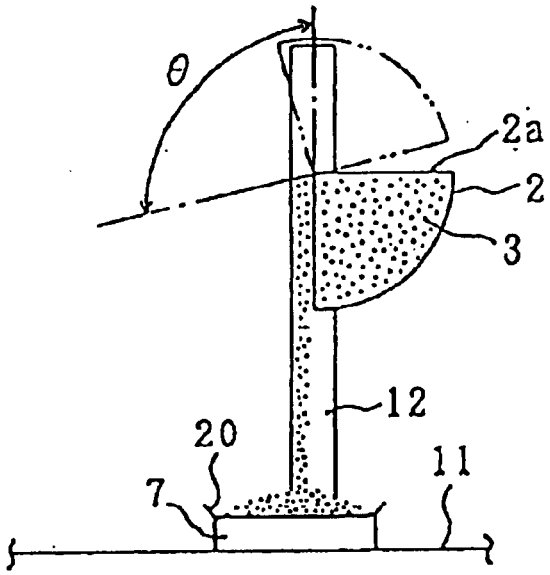
FIG. 2(1) is a schematic view showing the state of dropping powder by gradually tilting the holding member of a measurement device for flowability properties of the powder.
Figure 2:
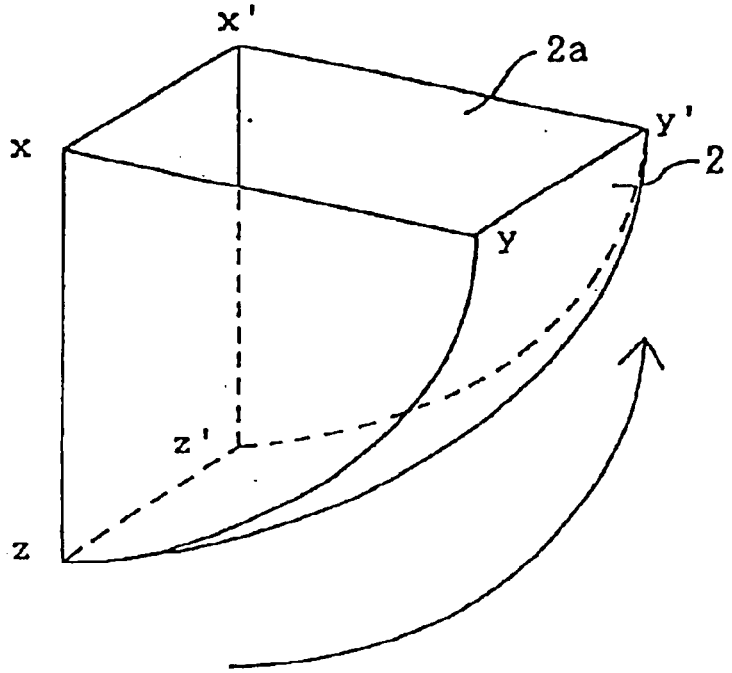

Δ Dropping ratio D introduced herein is defined as a difference of a dropping ratio (%) between a measurement sample and a standard powder, expressed as an average value within a given angle range, wherein the dropping ratio (%) is defined as a ratio of a weight dropped at a slanted angle θ of a holding member 2 shown in FIG. 2, based on an entire weight of the resulting measurement sample (or the standard powder), when the weight of the powder dropped while gradually tilting the holding member 2 packed with the measurement sample at a constant angular velocity with a passage of time is measured.

Figure 3:
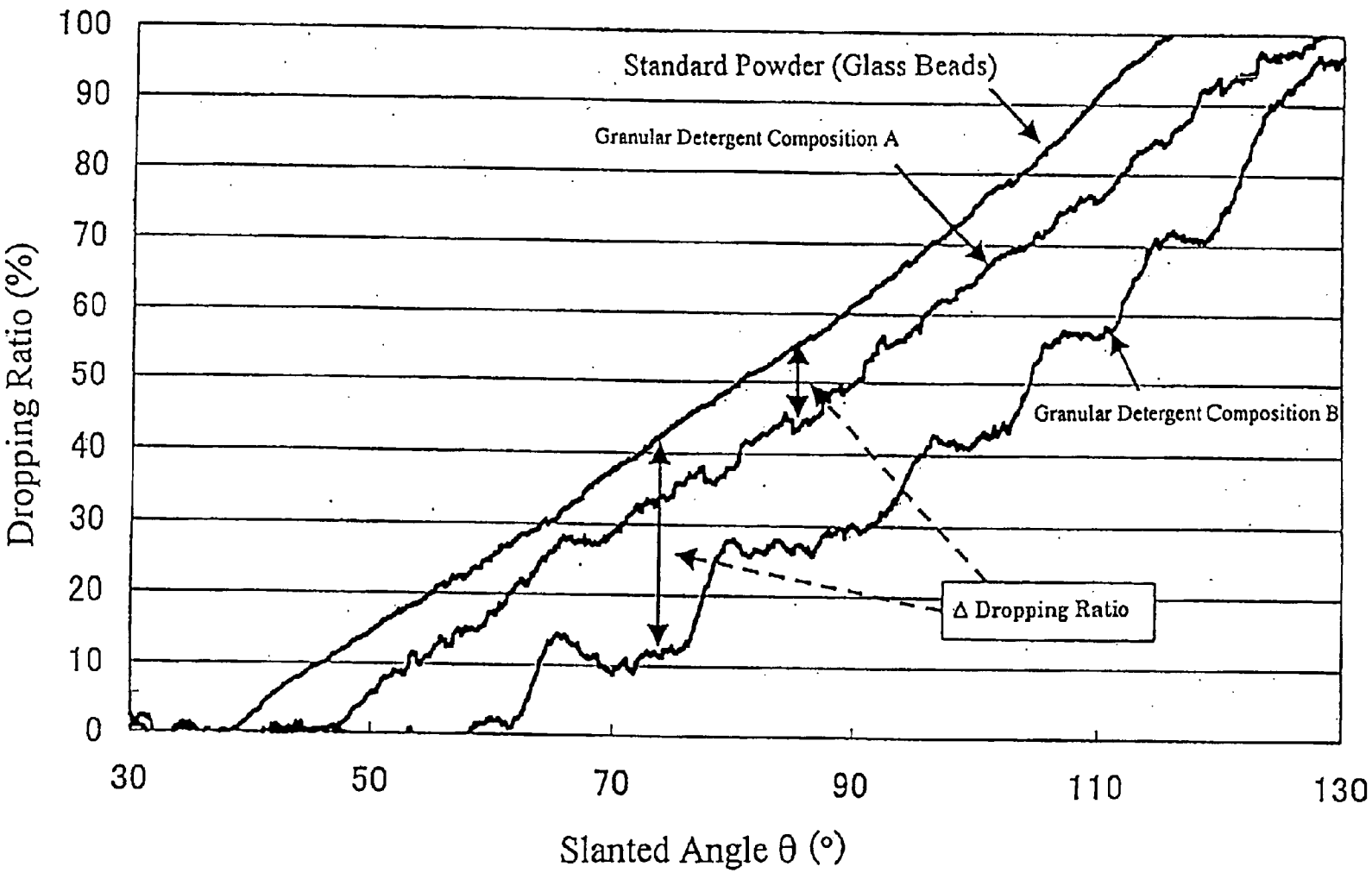
FIG. 3 is a graph showing an example of measurement for the Δ dropping ratio D.

The measurement example is shown in FIG. 3. Here, it is found that the granular detergent composition A of FIG. 3 more closely resembles the dropping behavior of the standard powder (glass beads), showing that the granular detergent composition packed in a spoon is dropped even with a slight slanted angle, and that on the other hand, in the granular detergent composition B, the granular detergent composition packed in the spoon is not dropped at a slight slanted angle, but once the dropping does take place, a large amount of the granular detergent composition tends to be dropped at once, so that it is very difficult to be measured with spoon-shaped measuring device.

From the above reasons, the Δ dropping ratio of the granular detergent composition of the present invention is adjusted to 14% or less, more preferably 12% or less, still more preferably 11% or less, especially preferably 10% or less, more preferably among especially preferable ones being 9% or less, still more preferably among especially preferable ones being 8% or less.

The Δ dropping ratio (D) is measured in the following manner.

The measurement experiment for the powder flowability properties is carried out by using a "measuring device for powder flowability properties" as shown in FIG. 1. The details for this device are described in paragraph numbers 0011 to 0016 of Japanese Patent Application No. Hei 10-374973. The measurement device 1 for powder flowability properties is provided for measuring the flowability properties of the powder 3 retained by a holding member 2, wherein the holding member 2 comprises a supporting mechanism 4, a tilted device 5, a tilted measurement device 6, a weight measurement device 7, and a computer 8. The supporting mechanism 4 comprises a base 11, a column 12 arranged thereon, and a rotating member 13 rotatably supported by the column, centering about a horizontal shaft, and the holding member 2 is detachably arranged to a snap portion (not illustrated in the figure), the snap portion being attached to a tip end of the rotating member 13. As shown in FIG. 2(2), the holding member 2 has a shape in which a cylinder is divided such that the shape of the perspective view of the end side is ¼ of a circle, which satisfies xx'=yy'=zz'=4 cm, xy=xz=x'y'=x'z'=5 cm, and ∠yxz=∠y'x'z'=90°, and wherein the holding member has a hollow structure (the above dimensions showing internals), wherein an upper aperture is a cascading portion 2*a* of the powder. In addition, a computer 8 is connected to an output device 9.

The tilted device 5 transmits the rotations of a motor 16 arranged on the base 11 to the above rotating member 13 through an electric-motor winding mechanism 17 and a decelerating mechanism 18. By rotating this rotating member 13, the holding member 2 supported by the above supporting mechanism 4 is gradually tilted at a set velocity. By the tilting, the powder 3 retained in the holding member 2 can be dropped from the cascading portion 2*a*. The motor 16 is connected to a rate-regulating device (not illustrated in the figure), and the tilting velocity of the holding member 2 can be regulated by varying the rotational speed.

A balance is used as a weight measurement device, and the values of weights are read in to the arithmetic device using an A/D converter. The accuracy of the balance is of the order of 0.01 gf. For instance, an electromagnetic balance "HF-2000" manufactured by Kensei Kogyo K.K., and the like can be used. As the A/D converter, there is used one such that an SN ratio of the values read in to the arithmetic device through the converter is 0.05 or less, wherein the SN ratio referred to herein is a value for a ratio of noise to a signal corresponding to an entire weight of the measurement sample used in the measurement of the Δ dropping ratio D.

The method of use by using the above device is such that the Δ dropping ratio is obtained by time-sequentially measuring a weight of the powder dropped by gradually tilting a holding member in accordance with the method described in paragraph numbers 0017 to 0019 of Japanese Patent Application No. Hei 10-259360 (Japanese Patent Laid-Open No. 2000-074811). Specifically, a cascading portion 2*a* is provided in the holding member 2 such that the cascading portion has a height of 20 cm from a receiver 20 of the weight measurement device 7, and then an angle of the holding member 2 is adjusted to 0°. Next, a measurement sample is poured to a cascading portion 2*a* in a sufficient amount using a funnel from a height of 10 cm above the cascading portion 2*a,* and thereafter a sample filled over the brim of the cascading portion 2*a* is removed by gentle leveling. The holding member 2 is rotated at an angular velocity of 6.0° per one second, until an angle θ of the holding member 2 is changed from 0° to 180°. During this period, the measurement of the dropped weight of the sample (powder 3) is taken every 1/80 seconds with a weight measurement device 7, and the θ and the dropped weight at an instant time are sequentially recorded.

Thereafter, the ratio of the dropped weight at a slanted angle θ of the holding member 2 to an entire weight of the measurement sample is defined as a dropping ratio (%) at an angle θ, and expressed as Y(θ). Next, the dropping ratio (%) is obtained in the same manner for the standard powder, and expressed as X(θ). However, in order to reduce noise, the dropping ratio at a slant θ of the holding member 2 is defined by carrying out the following data processing.

The dropping ratio (%) at an angle θ is defined by a ratio of a dropped weight at an angle θ to an entire weight of the measurement sample, wherein the dropped weight at an angle θ is an average value of measurement values of the dropped weights of a total of 40 points from an angle of (θ−2.925)° to an angle θ.

Here, the difference in the dropping ratios, i.e. X(θ)−Y(θ), is obtained for 50°≦θ≦110°, and its average value is defined as a Δ dropping ratio D (%). In addition, as a standard powder, there is used one prepared by classifying glass beads having a specific gravity at 20° C. of 2.5, a refractive index of 1.52, and a degree of spherocity of from 120 to 130 using a sieve defined by JIS Z 8801 to a size of from 425 to 500 μm, and sufficiently cleaning and drying the classified glass beads. As the glass beads, there can be used, for instance, glass beads "BZ-04" manufactured by IUCHI.

In addition, an A/D converter is used such that a vibrating width of the noise of the data for the dropping ratio obtained by the above data processing is 1.5% or less.

(3) Variance of Powder Dropping Rate (V)

In order to reduce inconveniences that the water-insoluble inorganic compounds remain on clothes, an important requirement for the granular detergent composition of the present invention is that the detergent is easily uniformly supplied (easily distributed) when supplying the detergent to a washing machine. The variance of the powder dropping rate V is an index which more accurately shows the extent of the flowability when supplying the granular detergent composition by tilting a spoon, as compared to an index of the flowability using the flow time from a hopper, or the like.

Figure 4:
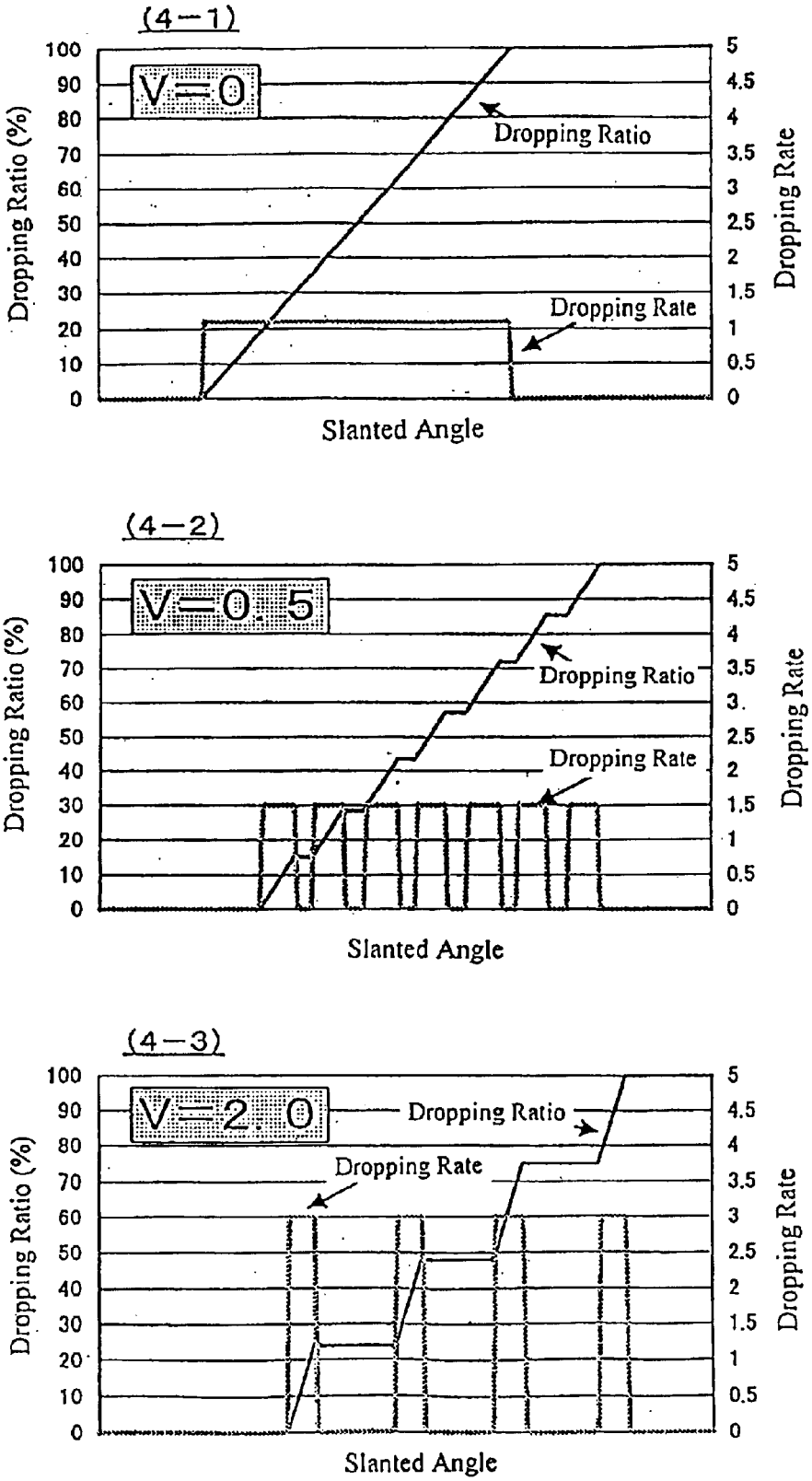
FIG. 4 each shows a model diagram showing the variance of powder dropping rate V. (4-1), (4-2), and (4-3) each shows a case where the variance of powder dropping rate V is 0, 0.5 and 2.0, respectively.

The variance of the powder dropping rate V introduced herein is measured in the same manner as in the measurement of the Δ dropping ratio D, by gradually tilting at a constant angular velocity with a passage of time, for the holding member 2 shown in FIG. 2 packed with the measurement sample. The dropped weight of the powder per unit time period (or unit angle) (referred to as "powder dropping rate") is obtained, and the mathematical variance of the powder dropping rate is obtained within the measured range. Concretely, as shown in FIG. 4, in a case of FIG. 4-1 where the powder is dropped continuously at a constant amount to a slanted angle θ, the powder dropping rate is constant, and the variance of the powder dropping rate V becomes 0. On the other hand, in cases of FIGS. 4-2 and 4-3 where the powder dropping is discontinuous to a slanted angle θ, there are variations in the dropping rates. Especially as shown in FIG. 4-3, the larger the V, the larger the discontinuity, indicating that the detergent is likely to be supplied in lumps into one spot when distributed.

Specifically, from the viewpoint of easy distributing (distributivity), the variance of the powder dropping rate V of the high-density granular detergent composition of the present invention is 1.0 or less, preferably 0.9 or less, more preferably 0.8 or less, still more preferably 0.7 or less, still more preferably 0.6 or less, especially preferably 0.4 or less.

The variance of the powder dropping rate V is measured in the following manner.

The measurement experiment for the powder flowability properties is carried out by using the "measuring device for powder flowability properties" which is the same one used for the measurement of the Δ dropping ratio. Concrete operations, which are similar to the measurement of the Δ dropping ratio described above, are as follows. A cascading portion 2*a* is provided in the holding member 2 such that the cascading portion has a height of 20 cm from a receiver 20 of the weight measurement device 7, and then an angle θ of the holding member 2 is adjusted to 0°. Next, a measurement sample is poured to a cascading portion 2*a* in a sufficient amount using a funnel from a height of 10 cm above the cascading portion 2*a,* and thereafter a sample filled over the brim of the cascading portion 2*a* is removed by gentle leveling. The holding member 2 is rotated at an angular velocity of 6.0° per one second, until the angle θ of the holding member 2 is changed from 0° to 180°. During this period, the measurement of the dropped weight of the sample is taken every 1/80 seconds with a weight measurement device 7, and the θ and the dropped weight at an instant time are sequentially recorded.

Thereafter, the differentiation value of the dropping ratio at a slanted angle θ of the holding member 2 is defined as a dropping rate at an angle θ (%/deg.), and denoted as v(θ). However, in order to reduce noise, the dropping ratio and the dropping rate at a slant θ of the holding member are defined by carrying out the following data processing.

The dropping ratio (%) at an angle θ is defined by a ratio of a dropped weight at an angle θ to an entire weight of the measurement sample, wherein the dropped weight at an angle θ is an average value of measurement values of the dropped weights of a total of 40 points from an angle of (θ−2.925)° to an angle θ.

The dropping rate at an angle θ is defined as a value (%/deg.) of a slope of a straight line obtained by plotting an angle as abscissa and the dropping ratio (%) described above as coordinate for a total of 19 points from angles (θ−0.675)° to (θ+0.675)°, and obtaining the slope of a straight line by least square method. In addition, the value of the slope of the straight line obtained by least square approximation mentioned above can be obtained in accordance with JIS Z 8901.

Here, the dropping rate v(θ) (%/deg.) of the sample powder to the slanted angle θ(°) of the holding member 2 is measured, and the mathematical variance of the v(θ) value against the θ, in which the dropping ratio Y(θ) of the sample powder falls between 1% and 99%, is calculated. This variance is defined as the variance of the powder dropping rate V.

In other words, the variance can be expressed by:

$$V=(n\Sigma(v(\theta))^2-(\Sigma v(\theta))^2)/n^2$$

wherein n is a total number of data in which Y(θ) falls between 1% and 99%.

(4) Index K

In the present invention, an index K as shown in the equation (1):

$$K=P\times\exp(0.135\times D) \quad (1)$$

wherein P is an inserting pressure (gf/cm); and D is a Δ dropping ratio (%), is introduced as an index for synthetically expressing easiness of a series of movements of scooping and measuring a granular detergent composition using a spoon-shaped measuring device.

The present inventors have evaluated the relationship between easy scooping and easy measuring using granular detergent compositions having variously different inserting pressures P and Δ dropping ratios D by varying operating factors of two axes of the inserting pressure P and the Δ dropping ratio. As a result, the present inventors have found that when the above factors have a a relationship falling within a range, there can be obtained a granular detergent composition having easy measurability and distributivity suitable for spoon measurement having conveniences not found so far and smooth and powdery texture not conventionally found, which can also be expressed as "capable of scooping single-handedly without spilling, with a single-step measurement." This index K is an index expressing the relationship between the inserting pressure P and the Δ dropping ratio D at which a granular detergent composition having suitable easy measurability and distributivity is obtained.

From the above reasons, the index K of the granular detergent composition of the present invention is from 30 to 230. From the viewpoint of obtaining more preferable powder properties for easy scooping and easy measuring, the index is 230 or less, preferably 200 or less, more preferably 170 or less, still more preferably 150 or less, still more preferably 130 or less, especially preferably 110 or less, more preferably among especially preferably one being 100 or less. In addition, from the industrial and economical viewpoints, the index is 30 or more.

Since the granular detergent composition of the present invention has powder properties shown in items (1) to (4) described above, it has easy measurability and distributivity suitable for spoon measurement.

In addition, the above powder properties can be achieved by carrying out adjustment operations of powder properties such as the particle size adjustment, the granular shape adjustment and the adjustment of intergranular cohesive forces of the detergent particles constituting the granular detergent composition mentioned above. The adjustment factors of the powder properties will be described in detail below.

3. Adjustment Factors of Powder Properties

In order to obtain a granular detergent composition having easy measurability and distributivity suitable for use with a spoon measurement in which each of the inserting pressure (P), the Δ dropping ratio (D), the variance of powder dropping rate (V) and the index K mentioned above takes a desired value, the adjustment factors include particle size adjustment factors such as an average particle size, a particle size distribution (Rosin-Rammler's distribution index), and a fine powder ratio of those having a particle size of 125 μm or less; a granular shape adjustment factor such as a degree of spherocity; and an adjustment factor for intergranular cohesive forces such as tensile strength of the powder layer. The adjustments of these adjustment factors affect the influence of any one of the powder properties among the inserting pressure (P), the Δ dropping ratio (D), the variance of powder dropping rate (V), and the property index K, or a plurality of the powder properties. What is to be especially remarked herein is that these adjustment factors can complement each other. Therefore, even in a case where a particular factor among those mentioned above does not take a sufficiently desirable value, in the granular detergent composition which is especially excellent in other factors, the above powder properties can be achieved to take desired values. The adjustment factors will be individually described hereinbelow.

(1) Particle Size Adjustment Factor (1-1) Average Particle Size

The high-density granular detergent composition of the present invention is excellent in the easy scooping and the measurability, and also in easy distributing.

The term "easy scooping" means that when a granular detergent composition is scooped with a spoon-shaped measuring device, the resistivity when the measuring device is inserted into the granules is small. In order to make the resistivity small, it is important to facilitate the movement of the granules when the measuring device is inserted by making an average particle size of the granules small. However, when the average particle size becomes too small, the aggregation force of the granules themselves becomes high, so that the flowability becomes poor. Therefore, in order to obtain easy scooping and excellent flowability, the average particle size (e) of the high-density granular detergent composition of the present invention is adjusted to preferably from 200 to 500 μm, more preferably from 220 to 450 μm, still more preferably from 220 to 400 μm, still more preferably from 220 to 370 μm, still more preferably from 220 to 340 μm.

The average particle size (e) is measured using sieves according to JIS Z 8801. For example, nine-step sieves each having a sieve-opening of 2000 μm, 1400 μm, 1000 μm, 710 μm, 500 μm, 355 μm, 250 μm, 180 μm, or 125 μm, and a receiving tray are used, and the sieves and the receiving tray are attached to a rotating and tapping shaker machine (manufactured by HEIKO SEISAKUSHO, tapping: 156 times/min, rolling: 290 times/min). A 100 g sample is vibrated for 10 minutes to be classified. Thereafter, the mass base frequency is sequentially cumulated for each of sieve-on granules in the order of the receiving tray, and sieves having a sieve-opening of 125 μm, 180 μm, 250 μm, 355 μm, 500 μm, 710 μm, 1000 μm, 1400 μm, and 2000 μm. When a sieve-opening of a first sieve of which cumulative mass base frequency is 50% or more is defined as a μm, and a sieve-opening of one sieve-opening larger than a μm is defined as b μm, in the case where the cumulative mass base frequency from the receiving tray to the a μm-sieve is defined as c %, and the mass base frequency of granules on the a μm-sieve is defined as d %, the average particle size can be calculated according to the following equation:

$$e(\text{average particle size})=10^{A}:$$

wherein $$A=\frac{50-\left(c-\frac{d}{\log b-\log a}\times\log b\right)}{\frac{d}{\log b-\log a}}$$

Incidentally, the used sieves are appropriately selected, so that the particle size distribution of the measured powder can be accurately estimated.

(1-2) Particle Size Distribution

In order to make the Δ dropping ratio D and the variance of powder dropping rate V small, the smaller the packing ratio, the better. Regarding the powder packing ratio, various factors of the powder affect the packing ratio, and an especially important factor is the particle size distribution of the powder. The narrower the particle size distribution, the lower the value of the packing ratio, and the smaller the Δ dropping ratio and the variance of the powder dropping rate V.

A distribution index Z of the Rosin-Rammler's distribution is used as an index for expressing a breadth of the particle size distribution of the powder. The larger the Z value, the narrower the particle size distribution.

The distribution index Z of the Rosin-Rammler's distribution for the granular detergent composition of the present invention is preferably 2.0 or more, more preferably 2.2 or more, still more preferably 2.4 or more, still more preferably 2.6 or more, still more preferably 2.8 or more, still more preferably 3.0 or more, especially preferably 3.2 or more, from the viewpoint of excellent easy leveling to a measurement scale and easy distributing.

The distribution index Z of the Rosin-Rammler's distribution is measured using sieves according to JIS Z 8801. For example, nine-step sieves each having a sieve-opening of 2000 μm, 1400 μm, 1000 μm, 710 μm, 500 μm, 355 μm, 250 μm, 180 μm, or 125 μm, and a receiving tray are used, and the sieves and the receiving tray are attached to a rotating and tapping shaker machine (manufactured by HEIKO SEISAKUSHO, tapping: 156 times/min, rolling: 290 times/min). A 100 g sample is vibrated for 10 minutes to be classified. Thereafter, the distribution index is defined as a value for a slope of a straight line obtained by the least square approximation when plotting log·log (100/Y) against log X, wherein X is a size of sieve-opening of a sieve, and Y is an accumulated sieve-on weight percentage on each sieve. Here, the points satisfying that Y is 5% or less, and that Y is 95% or more are excluded from the above plot.

Incidentally, the used sieves are appropriately selected, so that the particle size distribution of the measured powder can be accurately estimated.

Here, the accumulated sieve-on weight percentage Y on each sieve can be obtained by cumulating the mass base frequency of sieve-on granules of a size of each sieve or larger. In addition, the value of the slope of the straight line obtained by the least square approximation mentioned above can be obtained by a method in accordance with JIS Z 8901.

(1-3) Fine Powder Ratio

In order to make the Δ dropping ratio and the variance of powder dropping rate V small, it is effective to make the fine powder ratio small. In the present invention, the fine powder ratio refers to a weight percentage of granules having a particle size of 125 μm or less of the granular detergent composition. The fine powder ratio of the granular detergent composition of the present invention is adjusted to preferably 10% or less, more preferably 8% or less, still more preferably 6% or less, especially preferably 4% or less.

In addition, a problem which may possibly take place when supplying a detergent includes generation of powder dusts of the fine powder. Because the fine powder floats in the air when supplying a detergent, the users choke over it, thereby giving unpleasant experience. Therefore, the amount of generated dusts F of the granular detergent composition of the present invention is adjusted to 50 CPM or less, preferably 20 CPM or less, more preferably 10 CPM, especially preferably 5 CPM, most preferably 0 CPM. In order to reduce the amount of generated dusts, it is important to reduce the amount of the fine powder having a particle size of 125 μm or less.

The amount of generated dusts (F) is defined as follows.

A funnel having an inner diameter of 1.7 cm and an openable aperture portion is charged with 100 ml of each powder, and set in a driftless room, and each powder is dropped from a height of 40 cm. At this time, a number of counts taken in a period of one minute from the moment of powder dropping using a laser-type counter for the amount of generated dusts arranged at a location 10 cm away in a horizontal direction from the center of the powder dropping point is defined as the amount of generated dusts F (CPM). As the laser-type counter for amount of generated dusts, there can be used, for instance, a laser powder dustmeter "DASUTOMEITO Model LD-1" manufactured by Shibata Kagaku Kikai Kogyo Kabushiki Kaisha.

(2) Granular Shape Adjustment Factor (2-1) Degree of Spherocity (C)

In order to allow easy movement of the granules when the spoon-shaped measuring device is inserted into the granular detergent composition, it is effective not only to make the particle size small but also to approximate the granules to a spherical shape. In addition, the granules approximated to a spherical shape are excellent in the easy measuring and the easy distributing. Therefore, the degree of spherocity C of the granular detergent composition of the present invention is adjusted to preferably from 100 to 150, more preferably from 100 to 145, still more preferably from 100 to 140, most preferably from 100 to 135.

The degree of spherocity C of the granular detergent composition is measured in the following manner.

An image of a granule is photographed using a microscope. Regarding the image of the photographed granule, a ratio of an area of a circle circumscribing the image of the granule to an area of the image of the granule is determined, and a value obtained by multiplying the resulting ratio by 100 is referred to a degree of spherocity of the granule. In order to accurately reflect the particle size distribution, 500 or more granules are selected and the above measurements are taken for all of the granules, and its average value is referred to the degree of spherocity C of the granular detergent composition. In the above measurements, as the microscope, there can be used, for instance, a digital microscope "VH-6300" manufactured by KEYENCE. In addition, in the measurement of the degree of spherocity, there can be used, for instance, an image-analyzing system "LUZEX 2D" manufactured by NIKON CORPORATION, or the like.

(3) Adjustment Factor for Intergranular Cohesive Forces (3-1) Tensile Strength (T) of Powder Layer In order to make the Δ dropping ratio D or the variance of the powder dropping rate V small, it is most direct to reduce the interactive forces of the granules themselves. As an index for interactive forces of the powder, there can be used a tensile strength of a powder layer, which is interactive forces of the powder layers themselves. The tensile strength T of a powder layer of the granular detergent composition of the present invention is adjusted to preferably 30 mN or less, more preferably 20 mN or less, still more preferably 15 mN or less, still more preferably 10 mN or less, still more preferably 5 mN or less, especially preferably 2 mN or less, in order to reduce the interaction of the granules themselves, thereby making the Δ dropping ratio small.

The tensile strength (T) of the powder layer expresses levels of the cohesive forces and the aggregation forces of the powder, and the tensile strength can be obtained by, for instance, using COHETESTER MODEL CT-II manufactured by Hosokawa Micron Corporation. The COHETESTER refers to a machine having a cylindrical shape, which can measure the levels of the cohesive forces and the aggregation forces of the powder layers themselves, without detecting frictional forces, by pouring a sample powder into a cell divided into two portions at the center in a horizontal direction; uniformly applying a load in a vertical direction for a given time period; thereafter removing the load; and measuring a stress when drawing the cell in right-and-left directions.

The sample powder is poured so that the cross-sectional area of the powder layer is 10.0 $cm^2$, and a 1.00 kg load is uniformly applied thereon. Ten minutes thereafter, the load is removed, and a maximum value of stress when drawing the cell in a horizontal direction is referred to as a tensile strength T (mN) of the powder layer.

(4) Other Powder Properties (4-1) Surface Conditions of Granules

In order to reduce the interactive forces of the granules themselves and to make the Δ dropping ratio D and the variance of powder dropping rate V small, the surface conditions of the granules cannot be neglected. Since the granules with a smooth granular surface have small intergranular, frictional forces, the Δ dropping ratio and the variance of powder dropping rate become small.

(4-2) Bulk Density

The bulk density of the granular detergent composition of the present invention as determined by a method according to JIS K 3362 is a high density of 500 g/L or more. From the viewpoints of the improvement of the transportation efficiency and the convenience of users, the bulk density is 500 g/L or more, preferably 600 g/L or more, more preferably 700 g/L or more. In addition, from the viewpoints of not lowering the dispersibility by securing appropriate space between the granules, and by suppressing an increase of contact points between the granules, and the like, the bulk density is preferably 1200 g/L or less.

(4-3) Flowability

The flowability of the granular detergent composition of the present invention, which is evaluated by a flow time, is preferably 7.0 seconds or shorter, more preferably 6.5 seconds or shorter, still more preferably 6.0 seconds or shorter, especially preferably 5.5 seconds or shorter, more preferably among especially preferable ones being 5.0 seconds or shorter. The flow time refers to a time period required for cascading 100 mL of powder from a hopper used in a measurement of bulk density as defined in JIS K 3362.

4. Preparation Process

The process for obtaining a high-density granular detergent composition includes a process disclosed in Chapter 5 of Tokkyocho Koho: Shuchi and Kanyo Gijutsu Shu (Clothes Powder Detergent: Japanese Patent Office, published in March 26, 1998). However, in order to obtain the granular detergent composition having easy measurability and distributivity of the present invention which is suitable to be used with a spoon, the granular detergent composition cannot be obtained by simply following these ordinary processes and conditions, and the granular detergent composition having desired powder properties can be obtained by carrying out the particle size adjustment, the granular shape adjustment, and the adjustment of intergranular cohesive forces as mentioned above. Here, as for the particle size, it is preferable that the average particle size of the granular detergent composition is adjusted to a preferable range, so that the particle size distribution is made sharp, and that the amount of the fine powder having a size of less than 125 μm is made small. As for the granular shape, an adjustment is carried out, so that the degree of spherocity approximates 100, namely approximates a spherical shape. In addition, as for the intergranular cohesive forces, an adjustment for lowering the tensile strength of a powder layer is carried out, so that intergranular interactions are made small.

The phrase "adjustment . . . is carried out" as referred to herein is to select the formulation compositions, and the processes and the conditions for granulation and/or post-treatments after granulation, to give desired powder properties. Specifically, embodiments include a process comprising carrying out adjustments of various adjustment factors by selecting the formulation compositions and a process and conditions for granulation (carrying out granule design), thereby giving a granular detergent composition of the present invention without carrying out the specialized post-treatments after granulation; a process comprising carrying out adjustments of various adjustment factors in the post-treatment after granulation for the granular detergent composition obtained by an ordinary process and conditions, thereby giving a granular detergent composition of the present invention, or a combination of these methods.

A preferable process for readily obtaining a granular detergent composition of the present invention (a process for readily finding a method and conditions for the formulation composition, and granulation and/or post-treatments after granulation) includes a process comprising adjusting each of adjustment factors such as an average particle size, a particle size distribution (Rosin-Rammler's distribution index), a fine powder ratio having a particle size of 125 $\mu$m or less, a degree of spherocity and a tensile strength of a powder layer for the granular detergent composition to operable ranges which are preferable minimal requirements to be satisfied (referred to as "minimal required ranges"; the average particle size, the particle size distribution (Rosin-Rammler's distribution index), and the fine powder ratio being from 200 to 500 $\mu$m, 2.0 or more, and 10% or less, respectively; the degree of spherocity showing the granular shape being from 100 to 150; and the tensile strength of a powder layer showing the intergranular cohesive forces being 30 mN or less), wherein further two or more adjustment factors selected from the above items are adjusted to more preferable ranges (referred to as "especially preferable ranges"; the average particle size, the particle size distribution, and the fine powder ratio being from 220 to 450 $\mu$m, 2.6 or more, and 6% or less, respectively; the degree of spherocity expressing the granular shape being from 100 to 145; and the tensile strength of a powder layer expressing the intergranular cohesive forces being 15 mN or less). Here, the adjustment factors to be adjusted to especially preferable ranges are effectively adjusted by selecting factors which fall within the minimal required ranges, and most departing in the especially preferable ranges. In addition, during the course or after the termination of each of adjustment operations, the variance of the powder dropping rate V, the inserting pressure P, the $\Delta$ dropping ratio D and the index K are measured or calculated at each instance. When one or more of these items do not satisfy the ranges of $V \leqq 1.0$, $P \leqq 80$ gf/cm, $D \leqq 14\%$ and $30 \leqq K \leqq 230$, it is preferable to repeat the above adjustment operations. In addition, even if a particular adjustment factor is within the especially preferable range, it is effective to carry out a process of adjusting to a still more preferable range.

Incidentally, the minimally required ranges and the especially preferable ranges mentioned above are not limited to the above ranges. Each of the adjustment factors may be selected from each of preferable ranges mentioned above, so that when certain preferable ranges are taken as minimally required ranges, more preferable ranges are taken as especially preferable ranges.

In addition, once finding a process for obtaining a granular detergent composition of the present invention (formulation composition, and a process and conditions for granulation and/or post-treatment after granulation), the actual production of the granular detergent composition can be carried out, without measuring or calculating the variance of powder dropping rate V, the inserting pressure P, the $\Delta$ dropping ratio D, and the index K, and each of the adjustment factors in the course of the process.

Next, methods for adjusting each of the adjustment factors will be explained, without intending to limit the process for obtaining a granular detergent composition of the present invention to the processes mentioned below.

(1) Method for Adjusting Average Particle Size

It is preferable to adjust the average particle size of the granular detergent composition, thereby making the particle size distribution sharp. As the method for adjusting the average particle size, it is preferable to carry out a step of treating coarse granules or fine powder by some method such as classification with a sieve and air-classification. Regarding the granular detergent composition containing large amounts of coarse granules and having a large average particle size, a process comprises previously pulverizing the detergent composition, and combining a classification operation as occasion demands. In addition, a process for preparation comprising supporting a surfactant in a liquid state to base particles in which the average particle size and the particle size distribution are previously adjusted is effective for the adjustment of the average particle size and the particle size distribution.

(2) Method for Adjusting Degree of Spherocity

Regarding the adjustment of the degree of spherocity, there is a process of subjecting the detergent particles obtained by the granule production to a treatment of making a spherical shape such as plastic deformation and rounding off corners of the granules. As an alternative method, there is a method using granules having an excellent degree of spherocity as much as possible for a detergent raw material, for instance, spray-dried granules, and granulating with maintaining its shape. Concrete methods include a method described in Japanese Examined Patent Publication No. Sho 41-563, comprising rotating at a high speed a rotating member arranged at the bottom of a cylindrical granule-adjusting chamber, with keeping a side wall in a static state or rotating in an opposite direction of the rotating member; a method described in Japanese Patent Laid-Open No. Hei 2-232300, comprising continuously granulating by applying forces in a peripheral direction using a rotatable table having radial projections; a method described in Japanese Patent Laid-Open No. Sho 62-598, comprising contacting and colliding a granular detergent composition with the vessel wall by carrying the granular detergent composition with gaseous rotating current along a wall surface inside a vessel; and a method described in WO95/26394, comprising increasing a degree of spherocity by utilizing a shearing force generated by contacts of the granules themselves in a vessel rotary mixer. In addition, also included as an effective method is a preparation process comprising supporting a surfactant in a liquid state to spray-dried granules of which degree of spherocity is previously controlled.

(3) Method for Adjusting Particle Size Distribution

It is determined in the same manner as the method for adjusting the average particle size. In addition, it can be adjusted by appropriately blending granules once classified.

(4) Method for Adjusting Fine Powder Ratio

In the same manner as the method for adjusting the average particle size, a step comprising removing the fine powder by means of classification with sieves, air classification, and the like is carried out. In addition, in the preparation process comprising a pulverizing process, there is a tendency of increased fine powder ratio, so that a greater care is preferably paid.

(5) Method for Adjusting Tensile Strength of Powder Layer

Regarding the tensile strength of a powder layer, it is preferable to reduce the cohesive forces of the detergent particles themselves. The methods for reducing cohesive forces include 1) a mechanical treatment of the granular surface; and 2) a chemical treatment for suppressing bleeding out of the surfactant. The mechanical treatment method includes a method of coating the granular surface with fine powder (generally ultrafine powder), or further a method of lessening roughness (ruggedness) of the granular surface by applying an intergranular, weak shearing force by using a device as described in WO 95/26394. In addition, there is a method of reducing the number of contact points of the granules by adjusting the average particle size, the particle size distribution and the degree of spherocity. The chemical treatment methods include a method of adding a melting point-elevating agent for a liquid surfactant; a method of adding an anionic surfactant capable of having a lamellar orientation with the liquid surfactant; and a method of coating the surface with a water-soluble polymer, or the like.

(6) Method for Adjusting Surface Conditions of Granules

In the same manner as the method for adjusting the tensile strength of a powder layer, methods include a method of coating the granular surface with the fine powder (generally ultrafine powder, preferably those having a particle size of 5 μm or less and a sharp particle size distribution), and further a method of smoothening the granular surface by applying an intergranular, weak shearing force as mentioned above.

5. Detergent Article

According to the present invention, there is provided a detergent article comprising a container housing the granular detergent composition of the present invention, and a spoon-shaped measuring device used for measurement of the granular detergent composition. The detergent article of the present invention has all of the easy scooping, the easy measuring, and the easy distributing by the spoon-shaped measuring device, and gives a powdery smooth texture to the user in the operation using the spoon-shaped measuring device.

In addition, the detergent article can be suitably used for a high-density detergent article, measured with a measuring device other than spoons, including, for instance, super-concentrated granular detergent product housed in a measuring device-installed container described in Japanese Examined Patent Publication No. Hei 7-116480, a detergent housed in a bottle described in Japanese Patent Laid-Open No. Sho 53-43710, and the like.

EXAMPLES

Adjusted Preparation Example 1

Fourteen parts of a potassium linear alkyl(10 to 13 carbon atoms)benzenesulfonate; 8 parts of a sodium alkyl(14 to 16 carbon atoms)sulfate; 1 part of a polyoxyethylene(average moles of EO: 8) alkyl(12 to 14 carbon atoms)ether; 7 parts of a soap (14 to 20 carbon atoms); 10 parts of zeolite 4A; 1 part of No. 1 sodium silicate; 5 parts of sodium carbonate; 16 parts of potassium carbonate; 1.1 parts of sodium sulfate; 1.5 parts of sodium sulfite; 2 parts of sodium polyacrylate (average molecular weight: 10000); 2 parts of polyethylene glycol (average molecular weight: 8500); and fluorescent dyes (0.2 parts of Tinopal CBS-X and 0.1 parts of WHITEX SA) were mixed with water to prepare a slurry having a solid ingredient of 48% by weight (temperature: 65° C.). The resulting slurry was dried by using a countercurrent flow type spray-dryer to give granules having a bulk density of about 320 g/L. The content of volatile components was 3% (amount lost at 105° C. for 2 hours).

Next, 50 kg/H of the above granules, 4 kg/H of sodium carbonate (heavy ash), 1 kg/H of crystalline silicate powders (pulverized product of SKS-6, average particle size: 27 μm), and 3 kg/H of the above polyoxyethylene alkyl ether were continuously supplied to a continuous kneader (manufactured by Kurimoto Tekkosho K.K.). The resulting mixture was pelletized by using a twin-screw extruder ("PELLETER DOUBLE," manufactured by Fuji Paudal Co., Ltd.) arranged at the discharge outlet of the kneader, to give cylindrical pellets having a diameter of about 3 mm. While 5 parts of powdery zeolite (average particle size: about 3 μm) as a disintegration aid was added, based on 100 parts of the pellets, pulverizing and granulation process was carried out by a Fitz Mill (manufactured by Hosokawa Micron Corporation) equipped with a screen having a 1.5 mm-sieve opening with aeration of cool air at 14° C.

The results of various kinds of the properties (average particles size, particle size distribution, fine powder ratio, degree of spherocity, tensile strength of powder layer, inserting pressure, Δ dropping ratio, K value, variance of dropping rate, amount of dust generated) measured for the resulting granular detergent composition are shown in Table 1. These properties were measured by the methods described in the respective items described above (The same can be said for the measurement for the properties of the resulting granular detergent composition in each of the following adjusted preparation examples).

Adjusted Preparation Example 2

The granular detergent composition of Adjusted Preparation Example 1 was re-pulverized by a Fitz Mill, and thereafter coarse granules having a size of 850 μm or more were removed with a sieve. Further, fine powders were lessened by a fluidized bed. The properties of the resulting granular detergent composition are shown in Table 1.

Adjusted Preparation Example 3

Twenty kilograms of the granular detergent composition of Adjusted Preparation Example 2 was supplied at a volume packing ratio of 30% into a drum-type mixer having a cylindrical diameter of 400 mm, a cylindrical length of 600 mm, and a volume of 75.4 L. In addition, 0.3 kg of a crystalline aluminosilicate was simultaneously supplied thereto as a fine powder. The components were subjected to a surface treatment for 30 minutes in the drum-type mixer with a Froude number of 0.3 at a rotational speed of 37 rpm, while keeping the temperature of the powder between 45° and 55° C. The final temperature of the powder was 51° C. The properties of the resulting granular detergent composition are shown in Table 1.

Adjusted Preparation Example 4

A granular detergent composition was obtained by the following method.

A base granule was first prepared as follows.

A slurry comprising 480 kg of water, 222 kg of sodium sulfate, 120 kg of a 40% by weight aqueous solution of sodium polyacrylate, and 300 kg of zeolite was subjected to spray-drying, and the resulting spray-dried granule was used as a base granule. This base granule had an average particle size of 250 μm, a bulk density of 650 g/L, a supporting ability of 25 mL/100 g, a particle strength of 450 kg/cm$^2$, and a composition (weight ratio) of zeolite/sodium polyacrylate/sodium sulfate/water=50/8/37/5.

Next, a surfactant composition was prepared. Eighteen parts by weight (5.4 kg) of the above polyoxyethylene alkyl ether, 2 parts by weight (0.6 kg) of the polyethylene glycol, and 8 parts by weight (2.4 kg) of palmitic acid were mixed, and adjusted to 80° C.

Twenty-five parts by weight (9 kg) of the base granule described above, 30 parts by weight (9 kg) of a crystalline alkali metal silicate, and 7 parts by weight (2.1 kg) of an amorphous aluminosilicate were supplied into Lödige Mixer (manufactured by Matsuzaka Giken Co., Ltd.; capacity: 130 L; equipped with a jacket), and the rotations of a main shaft (rotational speed: 60 rpm) and a chopper (rotational speed: 3000 rpm) were started. Incidentally, hot water at 80° C. was allowed to flow into the jacket at 10 L/minute. Twenty-eight parts by weight (8.4 kg) of the surfactant composition described above was supplied into the above mixer in 3 minutes, and 8 minutes thereafter the agitation was terminated.

Next, 10 parts by weight (3 kg) of a crystalline aluminosilicate was supplied into the mixer, and agitated for 60 seconds. The components were discharged, and thereafter coarse granules were removed with a sieve having a 1410 μm-sieve opening. The properties of the resulting granular detergent composition are shown in Table 1.

Adjusted Preparation Example 5

A granular detergent composition of Adjusted Preparation Example 4 was adjusted as follows. Granules having a size of 125 μm or less and granules having a size of 500 μm or more in the above granular detergent composition were removed with sieves. The properties of the resulting granular detergent composition are shown in Table 1.

Adjusted Preparation Example 6

Twenty kilograms of the granular detergent composition of Adjusted Preparation Example 5 was supplied at a volume packing ratio of 30% into a drum-type mixer having a cylindrical diameter of 400 mm, a cylindrical length of 600 mm, and a volume of 75.4 L. In addition, 0.3 kg of a crystalline aluminosilicate was simultaneously supplied thereto as a fine powder. The components were subjected to a surface treatment for 30 minutes in the drum-type mixer with a Froude number of 0.3 at a rotational speed of 37 rpm. The properties of the resulting granular detergent composition are shown in Table 1.

Adjusted Preparation Example 7

A granular detergent composition was obtained by adding an enzyme granule (Savinase 18T Type W, manufactured by NOVO Nordisk) to the granule of Adjusted Preparation Example 6 so as to have an amount of 2 parts by weight based on 100 parts by weight of the granular detergent composition. The properties of the resulting granular detergent composition are shown in Table 1.

Adjusted Preparation Example 8

A granular detergent composition was obtained by the following method.

A base granule was first prepared as follows.

A slurry comprising 480 kg of water, 120 kg of sodium sulfate, 150 kg of sodium carbonate, 120 kg of a 40% by weight aqueous solution of sodium polyacrylate, and 252 kg of zeolite were subjected to spray-drying, and the resulting spray-dried granule was used as a base granule. This base granule had an average particle size of 270 μm, a bulk density of 580 g/L, a supporting ability of 55 mL/100 g, a particle strength of 250 kg/cm$^2$, and a composition (weight ratio) of zeolite/sodium polyacrylate/sodium carbonate/sodium sulfate/water=42/8/25/20/5.

Eighty parts by weight (24 kg) of the base granule described above was supplied into Lödige Mixer (manufactured by Matsuzaka Giken Co., Ltd.; capacity: 130 L; equipped with a jacket), and the rotation of a main shaft (rotational speed: 60 rpm) was started. Incidentally, a chopper was not rotated, and hot water at 80° C. was allowed to flow into the jacket at 10 L/minute. Twenty parts by weight of a surfactant composition at 80° C. (a mixture comprising 17 parts by weight of a polyoxyethylene alkyl ether, 1 part by weight of polyethylene glycol, 1 part by weight of sodium palmitate, and 1 part by weight of water: 6 kg) was supplied into the above mixer in 2 minutes, and thereafter the components were agitated for 5 minutes, to give a granular detergent composition. The properties of the resulting granular detergent composition are shown in Table 1.

Adjusted Preparation Example 9

A granular detergent composition of Adjusted Preparation Example 8 was adjusted as follows. Granules having a size of 125 μm or less and granules having a size of 500 μm or more in the above granular detergent composition were removed with sieves. The properties of the resulting granular detergent composition are shown in Table 1.

Adjusted Preparation Example 10

Twenty-five kilograms of the granular detergent composition of Adjusted Preparation Example 8 and 0.8 kg of a crystalline aluminosilicate were supplied into the above Lödige Mixer, and the rotations of a main shaft (rotational speed: 120 rpm) and a chopper (rotational speed: 3600 rpm) were carried out for 1 minute. The components were discharged, and thereafter coarse granules were removed with a sieve having a 710 μm-sieve opening. The properties of the resulting granular detergent composition are shown in Table 1.

Adjusted Preparation Example 11

Fifteen kilograms of the granular detergent composition of Adjusted Preparation Example 10 was supplied at a volume packing ratio of 30% into a drum-type mixer having a cylindrical diameter of 400 mm, a cylindrical length of 600 mm, and a volume of 75.4 L. In addition, 0.3 kg of a crystalline aluminosilicate was simultaneously supplied thereto as a fine powder. The components were subjected to a surface treatment for 20 minutes in the drum-type mixer with a Froude number of 0.3 at a rotational speed of 37 rpm. The properties of the resulting granular detergent composition are shown in Table 1.

Adjusted Preparation Example 12

The same base granule as that of Adjusted Preparation Example 8 was prepared.

Seventy-eight parts by weight (23.4 kg) of the base granule described above was supplied into Lödige Mixer (manufactured by Matsuzaka Giken Co., Ltd.; capacity: 130 L; equipped with a jacket), and the rotation of a main shaft (rotational speed: 60 rpm) was started. Incidentally, a chopper was not rotated, and hot water at 80° C. was allowed to flow into the jacket at 10 L/minute. Twenty-two parts by weight of a surfactant composition at 80° C. (a mixture comprising 10 parts by weight of a sodium linear alkyl(10 to 13 carbon atoms)benzenesulfonate, 8.5 parts by weight of polyoxyethylene alkyl ether, 1 part by weight of polyethylene glycol, 1 part by weight of sodium palmitate, and 1.5 parts by weight of water: 6.6 kg) was supplied into the above mixer in 2 minutes, and thereafter the components were agitated for 10 minutes, to give a granular detergent composition.

Further, 25 kg of the resulting granular detergent composition and 0.8 kg of a crystalline aluminosilicate were supplied into the above Lödige Mixer, and the rotations of a main shaft (rotational speed: 120 rpm) and a chopper (rotational speed: 3600 rpm) were carried out for 1 minute.

Twenty kilograms of the resulting granular detergent composition was supplied at a volume packing ratio of 30% into a drum-type mixer having a cylindrical diameter of 400 mm, a cylindrical length of 600 mm, and a volume of 75.4 L. In addition, 0.3 kg of a crystalline aluminosilicate was simultaneously supplied thereto as a fine powder. The components were subjected to a surface treatment for 30 minutes in the drum-type mixer with a Froude number of 0.3 at a rotational speed of 37 rpm.

Granules having a size of 125 μm or less and granules having a size of 500 μm or more in the above granular composition were removed with sieves. The properties of the resulting granular detergent composition are shown in Table 1.

TABLE 1

| | Adjust. Prep. Ex. 1 | Adjust. Prep. Ex. 2 | Adjust. Prep. Ex. 3 | Adjust. Prep. Ex. 4 | Adjust. Prep. Ex. 5 | Adjust. Prep. Ex. 6 |
|---|---|---|---|---|---|---|
| Average Particle Size | 535 | 349 | 345 | 405 | 355 | 355 |
| Particle Size Distribution | 1.7 | 2.7 | 2.8 | 2.5 | 3.3 | 3.4 |
| Fine Powder Ratio | 8.5 | 4.2 | 2.3 | 10.6 | 0.2 | 0.1 |
| Degree of Spherocity | 156 | 156 | 142 | 148 | 148 | 139 |
| Tensile Strength of Powder Layer | 12 | 10 | 3 | 14 | 12 | 10 |
| Inserting Pressure | 98 | 66 | 34 | 37 | 31 | 25 |
| Δ Dropping Ratio | 18.0 | 16.7 | 9.6 | 16.0 | 12.2 | 10.8 |
| K Value | 1120 | 629 | 124 | 320 | 161 | 107 |
| Variance of Dropping Rate | 1.67 | 1.35 | 0.84 | 1.55 | 1.02 | 0.73 |
| Amount of Dust Generated | 802 | 315 | 131 | 3 | 0 | 0 |

| | Adjust. Prep. Ex. 7 | Adjust. Prep. Ex. 8 | Adjust. Prep. Ex. 9 | Adjust. Prep. Ex. 10 | Adjust. Prep. Ex. 11 | Adjust. Prep. Ex. 12 |
|---|---|---|---|---|---|---|
| Average Particle Size | 361 | 299 | 290 | 298 | 295 | 279 |
| Particle Size Distribution | 3.3 | 3.2 | 3.5 | 3.5 | 3.5 | 3.6 |
| Fine Powder Ratio | 0.1 | 3.1 | 0.1 | 0.3 | 0.2 | 0.1 |
| Degree of Spherocity | 139 | 143 | 142 | 141 | 137 | 137 |
| Tensile Strength of Powder Layer | 10 | 53 | 48 | 2 | 0 | 0 |
| Inserting Pressure | 26 | 23 | 23 | 23 | 20 | 19 |
| Δ Dropping Ratio | 10.9 | 18.0 | 16.9 | 8.9 | 7.2 | 7.1 |
| K Value | 113 | 261 | 225 | 76 | 53 | 50 |
| Variance of Dropping Rate | 0.76 | 2.32 | 1.85 | 0.55 | 0.32 | 0.29 |
| Amount of Dust Generated | 0 | 0 | 0 | 0 | 0 | 0 |

Here, as the polyoxyethylene alkyl ether, there was used one manufactured by Kao Corporation under the trade name of "EMULGEN 108 KM" (average moles of ethylene oxides: 8.5; number of carbon atoms in alkyl moiety: 12 to 14; melting point: 18° C.). As the polyethylene glycol, there was used one manufactured by Kao Corporation under the trade name of "K-PEG 6000" (average molecular weight: 8500; melting point: 60° C.). As palmitic acid, there was used one manufactured by Kao Corporation under the trade name of "LUNAC P-95." As sodium palmitate, there was used one prepared by neutralizing the above palmitic acid with sodium hydroxide.

As the crystalline aluminosilicate, there was used one manufactured by Zeobuilder under the trade name of "Zeolite 4A Powder" (average particle size: 3.5 μm). As the amorphous aluminosilicate, there was used a product prepared by pulverizing the composition of Adjusted Preparation Example 2 described in Japanese Patent Laid-Open No. Hei 9-132794 to an average particle size of 8 μm. As the crystalline alkali metal silicate, there was used a product prepared by pulverizing Na-SKS-6 manufactured by Clariant to a size of 23 μm.

Figure 7:
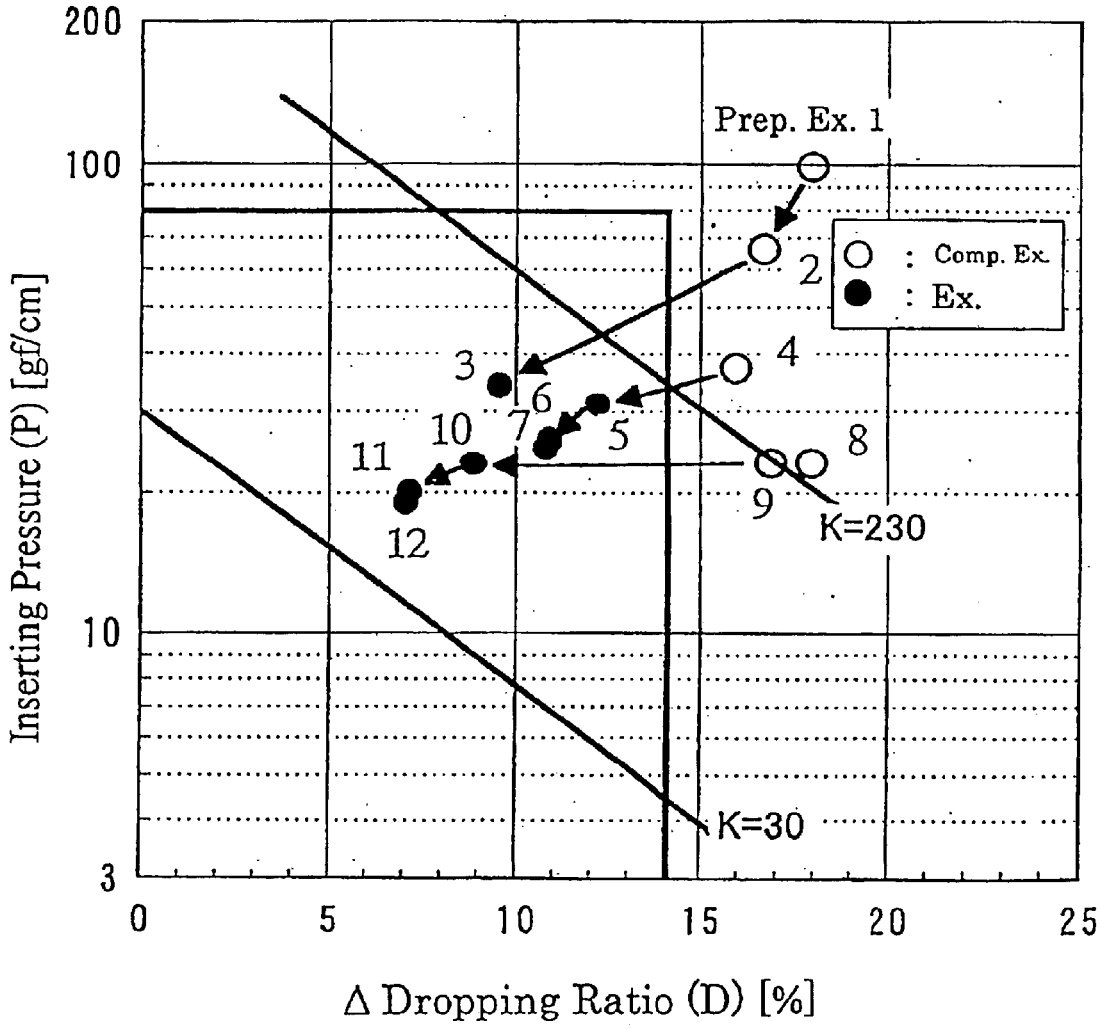
FIG. 7 is a plot of the Δ dropping ratio and the inserting pressure for each adjusted preparation example, and mapping its relationship with the ranges defined in the present invention.

In FIG. 7, the Δ dropping ratio and the inserting pressure are plotted for each of Adjusted Preparation Examples, and the scope of the invention is indicated therein. It is shown that an inventive product is obtained by adjusting according to the present invention the average particles size, the particle size distribution and the fine powder ratio, which are particle size adjustment factors; the degree of spherocity, which is a granular shape adjustment factor; and the tensile strength of a powder layer, which is an adjustment factor of intergranular cohesive forces. For example, Adjusted Preparation Example 1 is a granular detergent composition (comparative product) satisfying V=1.67, P=98, D=18.0, and K=1120. The granular detergent composition is subjected to pulverization, classification, and surface treatment of the granules as post-treatments, whereby the average particle size can be reduced, the particle size distribution can have a sharp peak, the fine powder ratio can be decreased, and the granular shape can approximate a spherical shape. By these post-treatments, the powder properties are greatly improved so as to satisfy V=0.84, P=34, D=9.6, and K=124 as in Adjusted Preparation Example 3, whereby a desired granular detergent composition in the present invention can be obtained. In addition, a granular detergent composition (comparative product) of Adjusted Preparation Example 4 is subjected to classification as a post-treatment, so that each of the fine powder ratio, the average particle size, and the particle size distribution is adjusted to a more favorable range, whereby an inventive product as in Adjusted Preparation Example 5 can be obtained. In addition, the granules are further subjected to surface treatment to improve the granular shape, whereby giving granular detergent compositions having more excellent powder properties (Adjusted Preparation Examples 6 and 7). In Adjusted Preparation Examples 8 and 9, while the average particle size, the particle size distribution, the fine powder ratio and the degree of spherocity are sufficiently within favorable ranges, and the value of P is excellent, the values of V and D are higher because the intergranular cohesive forces are high. Therefore, the granules are subjected to a surface-modifying process to reduce the intergranular cohesive forces, thereby giving a granular detergent composition having highly excellent powder properties (Adjusted Preparation Example 10), and by a further improvement in the degree of spherocity, a granular detergent composition having more excellent powder properties can be obtained (Adjusted Preparation Example 11). In addition, by continuously subjecting the granules to all of the adjustment steps for the powder properties as in Adjusted Preparation Example 12, an inventive product can also be obtained at once.

TEST EXAMPLES

All of the following tests were carried out in a thermostatic chamber kept at a temperature of 25°±5° C. at a humidity of 40±10%.

Test Example 1

The detergent composition obtained in each of Adjusted Preparation Examples was evaluated for an extent of less likeliness for a carton to move when scooping the granular detergent composition with a spoon as follows.

A sufficient amount of a sample was poured into a paper carton having a height of 52 mm, a length of 150 mm, a width of 91 mm and a thickness of 0.9 mm, from a height such that the distance between the bottom of the carton and the hopper aperture was 100 mm, using a hopper according to JIS K 3362. Thereafter, a sample filled over the brim of the carton was gently removed by leveling the surface of the sample so as not to change the packing state of the sample in the carton. Subsequently, a weight was gently attached to a peripheral portion of the carton packed with the sample, and a total weight was adjusted to 637 g. The carton subjected to the above adjustment was set in the device shown in FIG. 5 (1), with paying attention not to change the packing state of the sample, and not to adhere detergent granules to the bottom of the carton.

The device schematically carries out the step of scooping and measuring a detergent with a spoon-shaped measuring device 22, wherein the spoon-shaped measuring device 22 attached to a shaft 26 rotated by a motor 25 rotates, whereby a sample can be scooped from the carton 21 packed with the sample.

Figure 6:
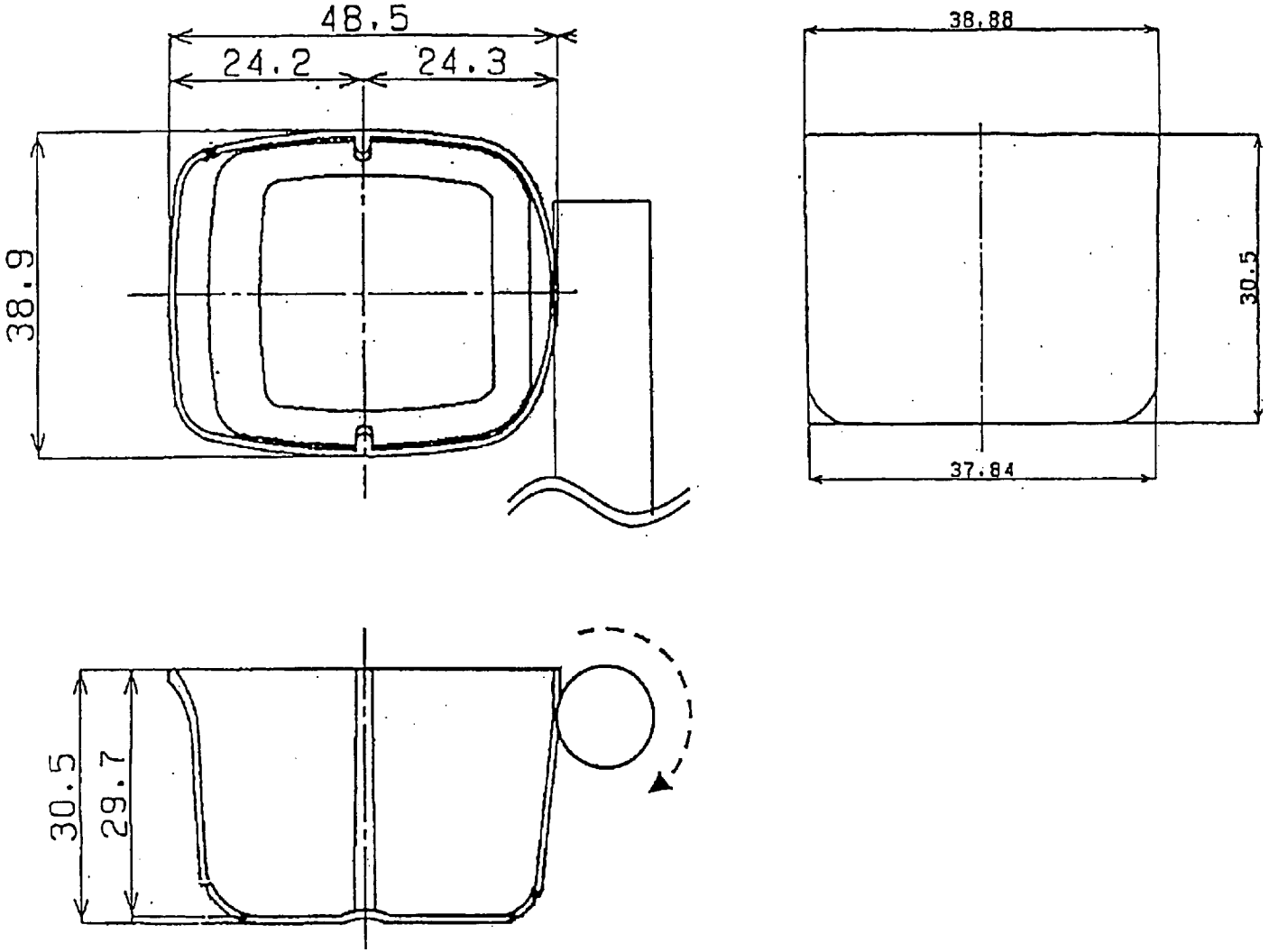
FIG. 6 is an enlarged view of the spoon-shaped measuring device.

The spoon-shaped measuring device 22 is a plastic measuring device having a shape as shown in FIG. 6, and is connected to a rotary shaft as shown in the same figure.

A table on which the carton 21 is placed is a smooth and clean glass plate 23. The height of the table can be adjusted as desired by means of a jack 24 provided under the table. The table is so arranged that its surface is completely horizontal.

Figure 5:
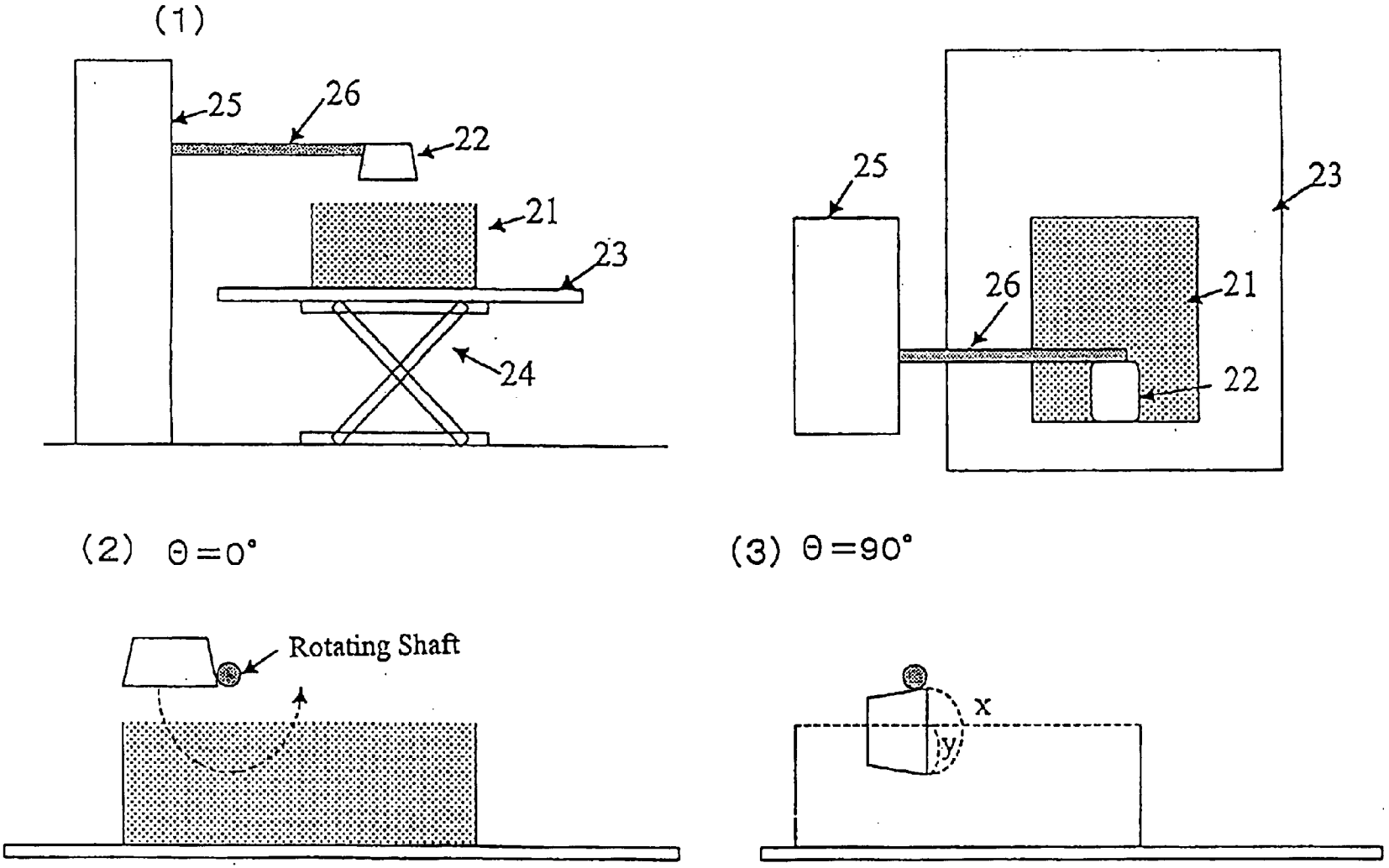
FIG. 5 is a schematic view showing a measurement device for powder properties of the powder. (1) shows a side view of the device (left diagram); and a planar view of the device (right diagram). (2) is a schematic view showing a state in which the spoon-shaped measuring device 22 is rotated about a shaft 26. (3) shows a state of the spoon-shaped measuring device 22 when rotated 90° from that of stage (2).

As shown in FIG. 5 (2), a state in which the cascading portion of the spoon-shaped measuring device 22 facing the sample surface in parallel was defined as a standard, and an angle rotated therefrom was defined as θ. As shown in FIG. 5 (3), $$(y/x)\times 100$$

was a spoon-inserting ratio q (%), wherein the distance for which the cascading portion of the spoon-shaped measuring device 22 was inserted into the internal of the carton 21 when satisfying θ=90° was y, and the length of the aperture of the spoon-shaped measuring device 22 was x.

The spoon-shaped measuring device 22 was rotated from θ=0° to 180° at an angular velocity of 19.3°/sec., and the distance z (mm) for the carton 21 to be moved by a force generated between the spoon and the sample at this instance was measured.

The above experiment was carried out with changing the spoon-inserting ratio q with 2% step, and the largest q among q's satisfying z<3 mm was a critical inserting ratio Q (%).

The above experiment was carried out for the detergent composition obtained in each of Adjusted Preparation Examples, and the extent of less likeliness for a carton to move when scooping the granular detergent composition with a spoon was scored as shown below from the value of the critical inserting ratio.

1: Q being 105% or more;
2: Q being 100% or more and less than 105%;
3: Q being 95% or more and less than 100%;
4: Q being 90% or more and less than 95%; and
5: Q being less than 90%.

The results for each of the detergent compositions are shown in Table 2.

TABLE 2

| | Adjust. Prep. Ex. 1 | Adjust. Prep. Ex. 2 | Adjust. Prep. Ex. 3 | Adjust. Prep. Ex. 4 | Adjust. Prep. Ex. 5 | Adjust. Prep. Ex. 6 |
|---|---|---|---|---|---|---|
| Critical Inserting Pressure | 4 | 3 | 2 | 2 | 2 | 1 |
| | Adjust. Prep. Ex. 7 | Adjust. Prep. Ex. 8 | Adjust. Prep. Ex. 9 | Adjust. Prep. Ex. 10 | Adjust. Prep. Ex. 11 | Adjust. Prep. Ex. 12 |
| Critical Inserting Pressure | 1 | 1 | 1 | 1 | 1 | 1 |

Test Example 2

The detergent composition obtained in each of Adjusted Preparation Examples was evaluated for the single-step measurability (leveling property) when scooping the granular detergent composition with a spoon as follows.

A sample was packed in a paper carton, and the paper carton was arranged in the device shown in FIG. 5 in the same manner as in Test Example 1. In this measurement, q was set at 102%, and the carton 21 was fixed to the glass plate 23 so as not to be moved. The spoon-shaped measuring device 22 was rotated from a position of θ=0° at an angular velocity of 19.3°/sec, and the rotation was stopped at a position of θ=α(90°<α180°). Thereafter, the glass plate 23 and the carton 21 fixed thereto were gently brought downwardly at a speed of 1 mm/sec. by moving the jack 24, to have such a state that the spoon-shaped measuring device 22 and the sample within the carton 21 are completely separated. Here, the state of the sample contained in the spoon-shaped measuring device 22 was observed, and the photographic evaluation was made by the following criteria:

A: Being heaped up (the sample being contained in a volume of about 107% by volume or more, based on the internal volume of the spoon-shaped measuring device);

B: Being just full to the brim (the sample being contained in a volume of about 93% by volume or more and less than about 107% by volume, based on the internal volume of the spoon-shaped measuring device); and C: Only a small amount being contained (the sample being contained in a volume of less than about 93% by volume, based on the internal volume of the spoon-shaped measuring device).

The above experiment was carried out by changing the stopping angle α at 2° step. The smallest value among αs with an evaluation result of "B" was α', and the value obtained by subtracting α' from 180° was defined as a critical leveling angle S.

The above experiment was carried out for the detergent composition obtained in each of Adjusted Preparation Examples, and the single-step measurability when scooping the granular detergent composition with a spoon was scored as shown below from the values of the critical leveling angle S.

1: S being less than 45°;
2: S being 45° or more and less than 50°;
3: S being 50° or more and less than 55°;
4: S being 55° or more and less than 60°; and
5: S being 60° or more.

The results for each of the detergent compositions are shown in Table 3.

TABLE 3

| | Adjust. Prep. Ex. 1 | Adjust. Prep. Ex. 2 | Adjust. Prep. Ex. 3 | Adjust. Prep. Ex. 4 | Adjust. Prep. Ex. 5 | Adjust. Prep. Ex. 6 |
|---|---|---|---|---|---|---|
| Critical Leveling Angle | 4 | 4 | 1 | 3 | 2 | 2 |
| | Adjust. Prep. Ex. 7 | Adjust. Prep. Ex. 8 | Adjust. Prep. Ex. 9 | Adjust. Prep. Ex. 10 | Adjust. Prep. Ex. 11 | Adjust. Prep. Ex. 12 |
| Critical Leveling Angle | 2 | 5 | 4 | 1 | 1 | 1 |

Test Example 3

The granular detergent composition obtained in each of Adjusted Preparation Examples was evaluated for the extent of easy measuring with a spoon as follows.

One-thousand milliliters of a granular detergent composition was placed in a carton having a length of 10 cm, a width of 15 cm, and a height of 10 cm. The granular detergent composition was scooped from the above carton with a spoon-shaped measuring device comprising a measuring portion having a length of 5.0 cm, a width of 3.5 cm, and a depth of 3.0 cm, and a handle having a length of 5.5 cm. An operation of leveling the granular detergent composition to the measurement scale provided at a height of 2.5 cm from the bottom of the measuring portion was carried out as accurately as possible, with a time limit of within 10 seconds, and the weight of the measured granular detergent composition was determined.

The above-measurement was carried out 10 times. When a standard deviation of the measured values for 10 runs is σ, and an average value thereof is E, the smaller the value of σ/E of a granular detergent composition, the more accurate the granular detergent composition can be measured.

Taking into consideration that there are differences among individuals in the way of scooping and measuring, the above experiment was carried out for 10 panelists, and an average value of σ/E by 10 panelists was determined. The results for each of the Adjusted Preparation Examples are shown in Table 4.

TABLE 4

| | Adjust. Prep. Ex. 1 | Adjust. Prep. Ex. 2 | Adjust. Prep. Ex. 3 | Adjust. Prep. Ex. 4 | Adjust. Prep. Ex. 5 | Adjust. Prep. Ex. 6 |
|---|---|---|---|---|---|---|
| (σ/E) × 100 | 5.3 | 4.4 | 2.8 | 5.0 | 3.2 | 2.7 |
| | Adjust. Prep. Ex. 7 | Adjust. Prep. Ex. 8 | Adjust. Prep. Ex. 9 | Adjust. Prep. Ex. 10 | Adjust. Prep. Ex. 11 | Adjust. Prep. Ex. 12 |
| (σ/E) × 100 | 2.8 | 5.8 | 4.6 | 2.0 | 1.8 | 1.8 |

Test Example 4

Next, the detergent composition obtained in each of Adjusted Preparation Examples was evaluated for the extent of easy uniform-supplying into a washing machine as follows.

A granular detergent composition was scooped with the above spoon so as to measure off about 40 mL. The granular detergent composition measured off with the spoon was dropped to a circle-shaped paper having a diameter of 50 cm placed on a horizontal table from about 50 cm above the paper, with paying attention so that the granular detergent composition is dispersed as evenly as possible. The extent of uniform-supplying was visually evaluated by the following evaluation criteria:

1: Being almost evenly dispersed;
2: A portion of the detergent composition of about within 20% being present as lumpy masses;
3: A portion of the detergent composition of from about 20 to about 40% being present as lumpy masses;
4: A portion of the detergent composition of from about 40 to about 60% being present as lumpy masses; and
5: Almost an entire detergent composition being present as lumpy masses.

A granular detergent composition in which lumpy masses are present in a large amount provides the conditions that the insoluble remnants are more likely to be present.

The above experiment and evaluation for 10 panelists were carried out 10 times respectively, and an average value of a total of 100 evaluation values was determined. The results are shown in Table 5.

TABLE 5

| | Adjust. Prep. Ex. 1 | Adjust. Prep. Ex. 2 | Adjust. Prep. Ex. 3 | Adjust. Prep. Ex. 4 | Adjust. Prep. Ex. 5 | Adjust. Prep. Ex. 6 |
|---|---|---|---|---|---|---|
| Average Evaluation Value | 3.7 | 3.1 | 1.8 | 3.5 | 2.1 | 1.8 |
| | Adjust. Prep. Ex. 7 | Adjust. Prep. Ex. 8 | Adjust. Prep. Ex. 9 | Adjust. Prep. Ex. 10 | Adjust. Prep. Ex. 11 | Adjust. Prep. Ex. 12 |
| Average Evaluation Value | 1.8 | 3.9 | 3.4 | 1.4 | 1.2 | 1.1 |

Test Example 5

Ten panelists were asked to give an opinion on the powdery state of the granular detergent composition as to the resulting granular detergent composition in each of Adjusted Preparation Examples. As a result, as to the granular detergent compositions obtained in Adjusted Preparation Examples 1, 2, 4, 8 and 9, the panelists answered that the granular detergent compositions were found less likely to flow, not easily measured, and the like. As to the Adjusted Preparation Example 1, in particular, the panelists answered that the granular detergent composition was scooped scratchily, that the fine powder dusts were scattered, irritating their noses, and the like. On the other hand, as to the granular detergent compositions obtained in Adjusted Preparation Examples 3, 5 to 7, and 10 to 12, most of the panelists answered that the powder was easy to scoop, and that the powder had a smooth powdery texture; and all of the panelists answered that the granular detergent compositions obtained in Adjusted Preparation Examples 3, 5 to 7, and 10 to 12 were superior.

It was clarified from above that the attractiveness of marketed products could be sufficiently increased by dramatically improving the powder properties.

Test Example 6

Next, the granular detergent compositions obtained in Adjusted Preparation Examples 4 and 6 were evaluated for the state of the insoluble remnants, when actually carrying out washing with a washing machine, as follows.

Black, cotton T-shirts were supplied in an amount of 4.0 kg into a washtub of a fully automatic washing machine "MIZUKAEMASENKA NW-8P5" manufactured by Hitachi, Ltd., and 26.7 g of the granular detergent composition was dropped over the shirts with a spoon-shaped measuring device, with paying attention so that the granular detergent composition is dispersed as evenly as possible.

Thereafter, 40 L of tap water at 5° C. was poured into the washing machine over 5 minutes, and washing comprising the steps of washing with gentle water current for 10 minutes, rinsing once, and spin-drying for 4 minutes was carried out. At the time when all of the steps of washing were terminated, the washed T-shirts were taken out, and the state of the insoluble remnants of the detergent present on the T-shirts was visually evaluated by the following evaluation criteria:

[Evaluation Criteria]

1: No aggregates;
2: Substantially no aggregates (1 to 5 masses having a diameter of about 3 mm remaining found);
3: Aggregates remaining in small amounts (masses having a diameter of about 6 mm being found, and 10 or less masses having a diameter of from 3 to 10 mm being found); and
4: Aggregates remaining in large amounts (a large number of masses having a diameter exceeding 6 mm being found).

Each of the above experiment and evaluation for each granular detergent composition was carried out 10 times, and an average value of a total of 10 evaluation values was determined. As a result, the average value for the resulting granular detergent composition in Adjusted Preparation Example 4 was 2.7, and the average value for the resulting granular detergent composition in Adjusted Preparation Example 6 was 1.1.

Test Example 7

Figure 8:
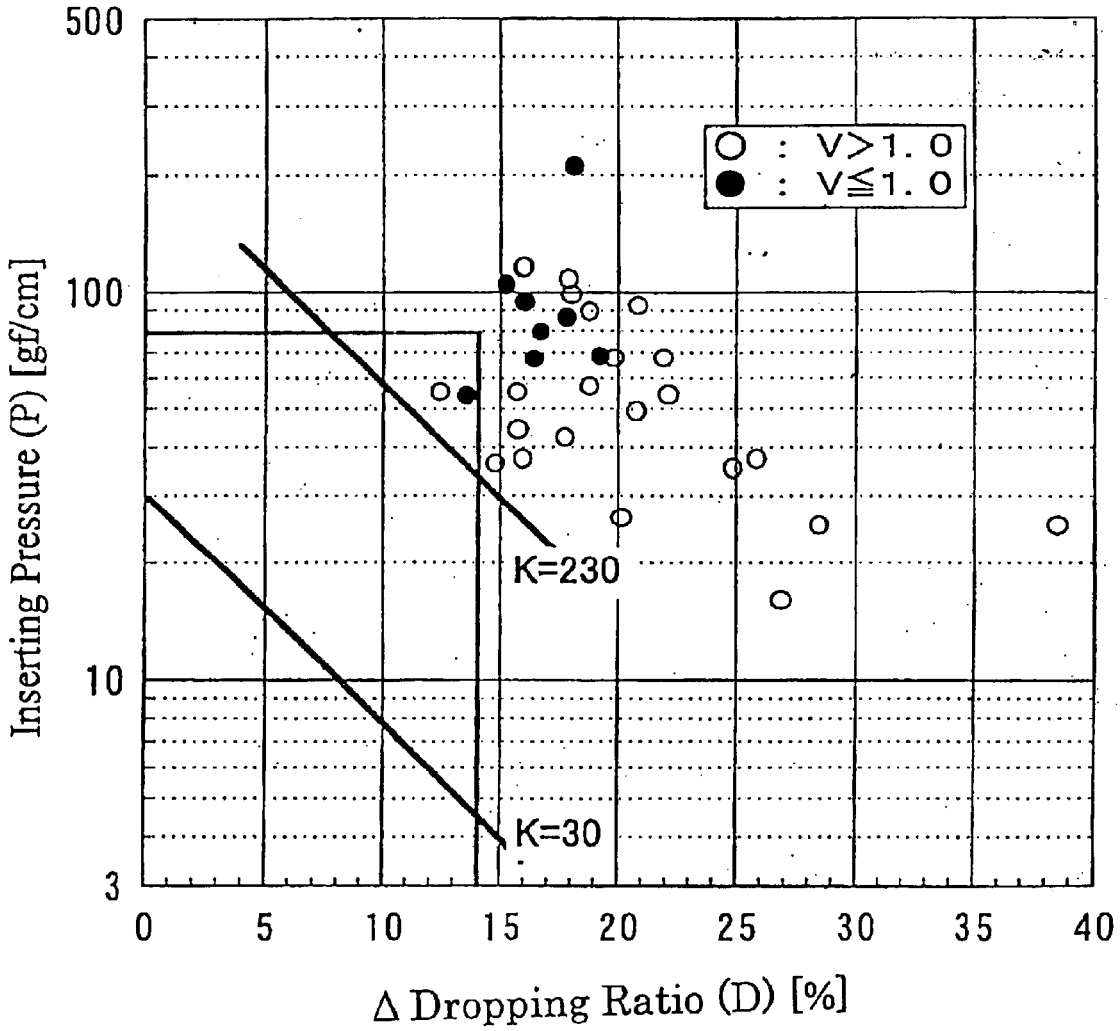
FIG. 8 is a plot of the Δ dropping ratio and the inserting pressure for 31 kinds of marketed products of the granular detergent compositions sold in Japan or elsewhere.

The data obtained for the variance of dropping rate V, the inserting pressure P, the Δ dropping ratio D and the K value for 31 kinds of marketed products of detergent compositions sold in Japan and elsewhere are shown in Table 6. In addition, FIG. 8 shows a plot for the above 31 kinds of marketed products. Since most of the marketed products have a value of the variance of powder dropping rate of more than 1.0, they are difficult to disperse, and the insoluble remnants are likely to be present during washing. In addition, even when the value of the variance of powder dropping rate is 1.0 or less, since the marketed products have a Δ dropping ratio of more than 14% except for Marketed Product 11, they are not satisfactory in the leveling property (single-step measurability) when measuring. In addition, in the case of those having an inserting pressure of more than 80 gf/cm, the carton is easier to move when scooping the detergent composition with a spoon-shaped measuring device. Marketed Product 11 has a variance of powder dropping rate of 0.84, an inserting pressure of 54 gf/cm, a Δ dropping ratio of 13.6%, and a K value of 339. Test Example 1 and Test Example 2 were carried out for this marketed product. As a result, the evaluation values for Test Example 1 (extent of less likeliness for a carton to move when scooping the detergent composition with a spoon-shaped measuring device) and Test Example 2 (single-step measurability) were each 3. However, when 10 panelists actually examined Marketed Product 11, the majority of the panelists had an opinion that Marketed Product 11 was inferior to those of Adjusted Preparation Examples 3, 5 to 7, and 10 to 12 in a series of movements for scooping and measuring the detergent composition with a spoon-shaped measuring device. Since those having a value of the variance of dropping rate of 1.0 or less are easy to disperse, the insoluble remnants are less likely to be present during washing. Moreover, those having a value of an inserting pressure of 80 gf/cm or less, a Δ dropping ratio of 14% or less, and a K value of 230 or less are easy to scoop and are easily measured. However, there do not exist marketed products having easy measurability and distributivity suitable for use with a spoon satisfying these properties which can be expressed as "capable of scooping single-handedly without spilling, with a single-step measurement, and with reduced insoluble remnants."

TABLE 6

| | | Powder properties | | | |
|---|---|---|---|---|---|
| Area/ Company | Marketed Product | Variance of Dropping Rate | Inserting Pressure (gf) | Δ Dropping Ratio (%) | K Value |
| Japan | | | | | |
| A Co. | 1 | 1.46 | 55 | 12.4 | 295 |
| | 2 | 1.08 | 55 | 15.7 | 459 |
| | 3 | 1.55 | 37 | 16.0 | 320 |
| B | 4 | 1.13 | 114 | 16.0 | 985 |
| | 5 | 1.67 | 98 | 18.0 | 1119 |
| | 6 | 1.26 | 107 | 17.9 | 1203 |
| | 7 | 1.00 | 68 | 19.3 | 916 |
| | 8 | 1.03 | 115 | 16.0 | 1000 |
| C | 9 | 1.89 | 54 | 22.1 | 1072 |
| | 10 | 2.23 | 37 | 25.9 | 1220 |
| D | 11 | 0.84 | 54 | 13.6 | 339 |
| E | 12 | 2.79 | 26 | 20.2 | 396 |
| F | 13 | 2.18 | 35 | 24.9 | 1011 |
| G | 14 | 2.75 | 25 | 28.5 | 1173 |
| H | 15 | 17.09 | 25 | 38.5 | 4533 |
| I | 16 | 1.77 | 92 | 20.9 | 1536 |
| U.S.A. | | | | | |
| J | 17 | 0.61 | 94 | 16.1 | 821 |
| | 18 | 1.01 | 79 | 16.7 | 756 |
| | 19 | 2.29 | 67 | 19.9 | 978 |
| | 20 | 0.93 | 86 | 17.9 | 960 |
| K | 21 | 1.33 | 42 | 17.8 | 461 |
| | 22 | 2.09 | 36 | 14.5 | 256 |

TABLE 6-continued

| Area/ Company | Marketed Product | Powder properties | | | |
|---|---|---|---|---|---|
| | | Variance of Dropping Rate | Inserting Pressure (gf) | Δ Dropping Ratio (%) | K Value |
| Europe | | | | | |
| L | 23 | 0.95 | 67 | 16.5 | 618 |
| M | 24 | 1.06 | 89 | 18.8 | 1134 |
| N | 25 | 0.65 | 210 | 18.2 | 2438 |
| China | | | | | |
| O | 26 | 2.13 | 57 | 18.8 | 724 |
| P | 27 | 2.95 | 16 | 26.9 | 604 |
| | 28 | 0.87 | 104 | 15.3 | 816 |
| | 29 | 2.11 | 67 | 21.9 | 1296 |
| Q | 30 | 2.11 | 44 | 15.8 | 369 |
| Australia | | | | | |
| R | 31 | 2.05 | 49 | 20.8 | 809 |

INDUSTRIAL APPLICABILITY

According to the present invention, since the detergent is easily scoopable and easily measurable when a user scoops the detergent using a spoon-shaped measuring device, and the detergent is easily dispersible in the washing machine, there can be provided a detergent composition having very high sense of feel and smooth powdery texture in which the remnants on clothes of the insoluble remnants after washing are remarkably reduced, and a detergent article housing the granular detergent composition.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A granular detergent composition having easy measurability and distributivity suitable for spoon measurement, a bulk density thereof being 500 g/L or more, comprising a surfactant, a water-insoluble inorganic compound and a water-soluble salt, wherein the granular detergent composition has a variance of powder dropping rate V of 1.0 or less, an inserting pressure P of 80 gf/cm or less, a Δ dropping ratio D of 14% or less, and an index K of from 30 to 230, the index K being represented by the equation (1):

$$K=P\times\exp(0.135\times D) \quad (1)$$

wherein

P stands for an inserting pressure (gf/cm), and D stands for a Δ dropping ratio (%); and wherein the following properties of particles of the granular detergent composition satisfy the following ranges:

average particle size : 200 to 500 μm, particle size distribution (Rosin-Rammler's) distribution index): 2.0 or more, fine powder ratio of a particle size of 125 μm or less: 10% or less, degree of spherocity: 100 to 145, and tensile strength of a powdery layer: 30 mN or less.

2. A process for preparing a granular detergent composition having easy measurability and distributivity suitable for spoon measurement, a bulk density thereof being 500 g/L or more, comprising a surfactant, a water-insoluble inorganic compound and a water-soluble salt, wherein the process comprises carrying out a particle size adjustment, a granular shape adjustment and an adjustment of intergranular cohesive forces such that the granular detergent composition has a variance of powder dropping rate V of 1.0 or less, an inserting pressure P of 80 gf/cm or less, a Δ dropping ratio D of 14% or less, and an index K of from 30 to 230, the index K being represented by the equation (1):

$$K=P\times\exp(0.135\times D) \quad (1)$$

wherein

P stands for an inserting pressure (gf/cm), and D stands for a Δ dropping ratio (%); and wherein the particle size adjustment, the granular shape adjustment and the adjustment of intergranular cohesive forces are carried out such that the detergent particles constituting the granular detergent composition have an average particle size, a particle size distribution (Rosin-Rammler's distribution index) and a fine powder ratio of a particle size of 125 μm or less, factors showing a particle size of the detergent particles, of from 200 to 500 μm, 2.0 or more, and 10% or less, respectively, and have a degree of spherocity, showing a granular shape, of from 100 to 150, and have a tensile strength of a powder layer, showing intergranular cohesive forces of 30 mN or less, further wherein two or more of the properties selected from the group consisting of the average particle size, the particle size distribution (Rosin-Rammler's distribution index), the fine powder ratio of a particle size of 125 μm or less, the degree of spherocity and the tensile strength of a powder layer satisfy the following ranges:

average particle size: 220 to 450 μm, particle size distribution (Rosin-Rammler's distribution index): 2.6 or more, fine powder ratio of a particle size of 125 μm or less: 6% or less, degree of spherocity: 100 to 145, tensile strength of a powdery layer: 15 mN or less.

3. A granular detergent composition having easy measurability and distributivity suitable for spoon measurement, a bulk density thereof being 500 g/L or more, comprising a surfactant, a water-insoluble inorganic compound and a water-soluble salt, and wherein the granular detergent composition has an average particle size, a particle size distribution (Rosin-Rammler's distribution index) and a fine powder ratio of a particle size of 125 μm or less, factors showing a particle size of the detergent particles, of from 200 to 500 μm, 2.0 or more, and 10% or less, respectively, and have a degree of spherocity, showing a granular shape, of from 100 to 150, and have a tensile strength of a powder layer, showing intergranular cohesive forces of 30 mN or less, further wherein two or more of the properties selected from the group consisting of the average particle size, the particle size distribution (Rosin-Rammler's distribution index), the fine powder ratio of a particle size of 125 μm or less, the degree of spherocity and the tensile strength of a powder layer satisfy the following ranges:

average particle size: 220 to 450 μm, particle size distribution (Rosin-Rammler's distribution index): 2.6 or more, fine powder ratio of a particle size of 125 μm or less: 6% or less, degree of spherocity: 100 to 145, tensile strength of a powdery layer: 15 mN or less.

* * * * *